US011707177B2

(12) United States Patent
Nguyen

(10) Patent No.: US 11,707,177 B2
(45) Date of Patent: Jul. 25, 2023

(54) SURFACE CLEANING APPARATUS

(71) Applicant: BISSELL Inc., Grand Rapids, MI (US)

(72) Inventor: Tom Minh Nguyen, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 17/671,874

(22) Filed: Feb. 15, 2022

(65) Prior Publication Data

US 2022/0167819 A1 Jun. 2, 2022

Related U.S. Application Data

(63) Continuation of application No. 16/544,372, filed on Aug. 19, 2019, now Pat. No. 11,284,767.
(Continued)

(51) Int. Cl.

| | |
|---|---|
| ***A47L 11/34*** | (2006.01) |
| ***A47L 7/00*** | (2006.01) |
| ***A47L 11/40*** | (2006.01) |
| ***A47L 5/28*** | (2006.01) |
| ***A47L 9/28*** | (2006.01) |
| ***A47L 9/32*** | (2006.01) |

(52) U.S. Cl.
CPC ..... *A47L 11/34* (2013.01); *A47L 5/28* (2013.01); *A47L 7/0009* (2013.01); *A47L 7/0023* (2013.01); *A47L 9/2868* (2013.01); *A47L 9/325* (2013.01); *A47L 11/4005* (2013.01); *A47L 11/4041* (2013.01); *A47L 11/4044* (2013.01); *A47L 11/4075* (2013.01); *A47L 11/4083* (2013.01)

(58) Field of Classification Search
CPC ..... A47L 11/34; A47L 7/0009; A47L 7/0023; A47L 11/4005; A47L 11/4041; A47L 11/4044; A47L 11/4083; A47L 9/0027; A47L 11/202; A47L 11/4016; A47L 11/4088; A47L 11/201; A47L 11/30; A47L 11/32; A46B 9/005; A46B 13/001
See application file for complete search history.

(56) References Cited

U.S. PATENT DOCUMENTS 5,896,617 A 4/1999 Kasen et al.
6,131,237 A 10/2000 Kasper et al.
(Continued)

FOREIGN PATENT DOCUMENTS

WO 2009042663 A1 4/2009

OTHER PUBLICATIONS

European Patent Office, European Search Report re Application No. 19193510.5-1016, dated Jan. 29, 2020, 9 pages, Munich Germany.
(Continued)

*Primary Examiner* — David Redding
(74) *Attorney, Agent, or Firm* — Warner Norcross + Judd LLP

(57) ABSTRACT

A surface cleaning apparatus having an upright assembly, a power source, and a coiled electrical cable. The upright assembly including a frame and a telescoping handle at last partially extending from the frame and movable between an extended position and a contracted position. The coiled electrical cable being provided within a portion of the telescoping handle and configured to uncoil or coil when the telescoping handle is moved between the extended position and the contracted position.

20 Claims, 17 Drawing Sheets

Related U.S. Application Data

(60) Provisional application No. 62/724,193, filed on Aug. 29, 2018.

(56) References Cited

U.S. PATENT DOCUMENTS

| | | | |
|---|---|---|---|
| 7,685,671 | B2 | 3/2010 | Jansen |
| 7,845,045 | B2 | 12/2010 | Lenkiewicz et al. |
| 7,908,705 | B2 | 3/2011 | VanderBaan |
| 8,966,709 | B2 | 3/2015 | Coleman et al. |
| 10,092,155 | B2 | 10/2018 | Xia et al. |
| 2006/0101608 | A1 | 5/2006 | Tong |
| 2008/0092325 | A1 | 4/2008 | Vander Baan |
| 2015/0020346 | A1 | 1/2015 | Vail et al. |
| 2017/0071434 | A1 | 3/2017 | Nguyen et al. |
| 2017/0150859 | A1 | 6/2017 | Muir |
| 2020/0060503 | A1 | 2/2020 | Davila et al. |

OTHER PUBLICATIONS

European Patent Office, Extended European Search Report re Application No. 19193510.5-1016 / 3616589, dated Jun. 8, 2020, 16 pages, Munich Germany.

SURFACE CLEANING APPARATUS

CROSS-REFERENCE TO RELATED APPLICATION(S)

This application is a continuation of U.S. application Ser. No. 16/544,372, filed Aug. 19, 2019, now allowed, which claims the benefit of U.S. Provisional Patent Application No. 62/724,193, filed Aug. 29, 2018, all of which are incorporated herein by reference in their entirety.

BACKGROUND

Extraction cleaners are well-known surface cleaning apparatuses for deep cleaning carpets and other fabric surfaces, such as upholstery. Most carpet extractors comprise a fluid delivery system that delivers cleaning fluid to a surface to be cleaned and a fluid recovery system that extracts spent cleaning fluid and debris (which may include dirt, dust, stains, soil, hair, and other debris) from the surface. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. An agitator can be provided for agitating the cleaning fluid on the surface. The fluid recovery system usually comprises a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank. Other surface cleaning apparatuses include vacuum cleaners, which can have a nozzle adjacent the surface to be cleaned in fluid communication with a collection system and an agitator can be provided for agitating the cleaning fluid on the surface.

BRIEF DESCRIPTION

An aspect of the present disclosure relates to a surface cleaning apparatus, comprising an upright assembly including a frame and a telescoping handle at least partially extending form the frame, the telescoping handle moveable between an extended position and a contracted position, a power source operably coupled to at least a portion of the upright handle assembly, and a coiled electrical cable provided within a portion of the telescoping handle and operably coupled to the power source, the coiled electrical cable configured to uncoil or coil when the telescoping handle is moved between the extended position and the contracted position.

DETAILED DESCRIPTION

Figure 1:
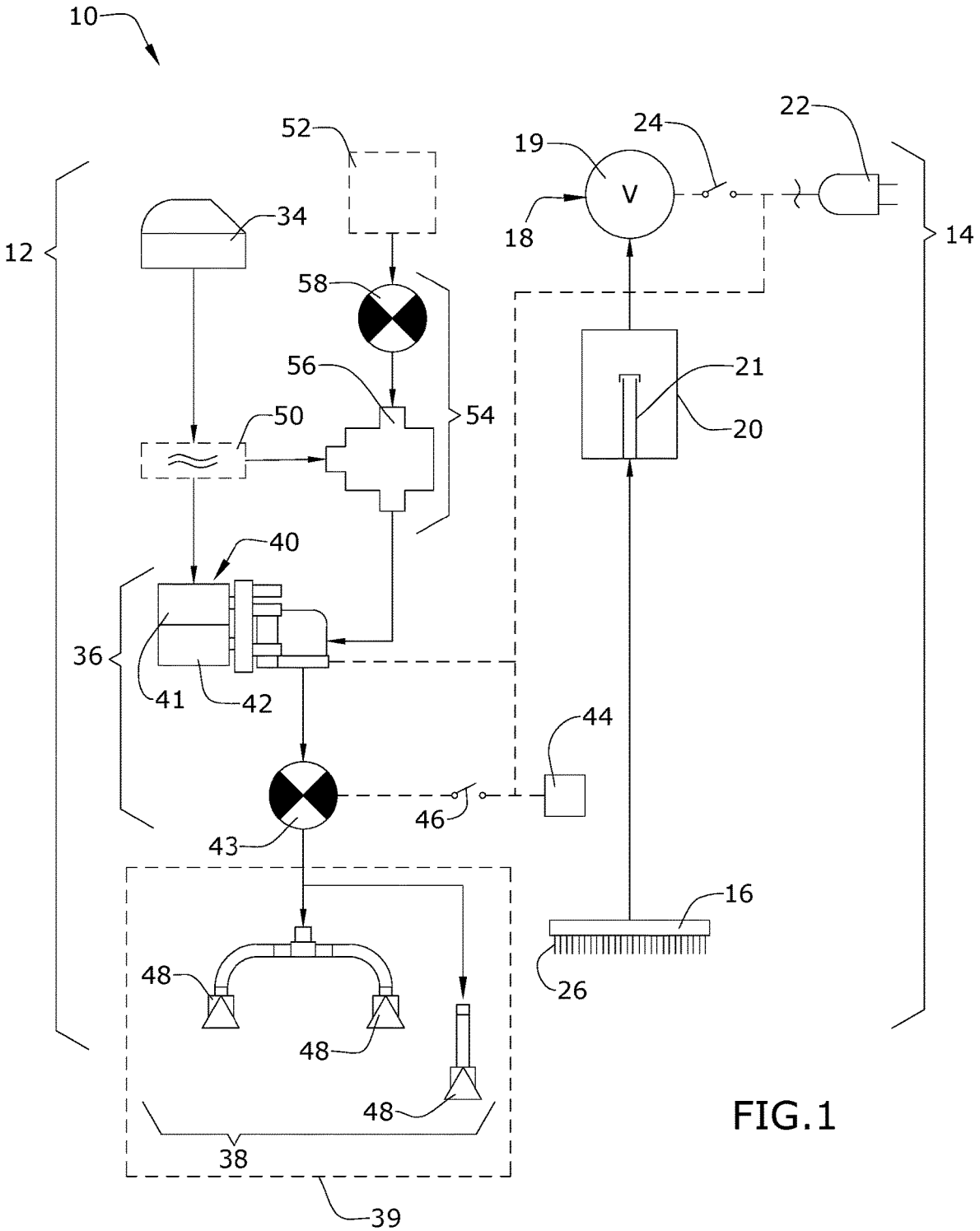
FIG. 1 is a schematic view of an exemplary surface cleaning apparatus according to various aspects described herein.

FIG. 1 is a schematic view of various functional systems of a surface cleaning apparatus in the form of an exemplary extraction cleaner 10. The functional systems of the exemplary extraction cleaner 10 can be arranged into any desired configuration, such as an upright extraction device having a base and an upright body for directing the base across the surface to be cleaned, a canister device having a cleaning implement connected to a wheeled base by a vacuum hose, a portable extractor adapted to be hand carried by a user for cleaning relatively small areas, or a commercial extractor. Any of the aforementioned extraction cleaners can be adapted to include a flexible vacuum hose, which can form a portion of the working air conduit between a nozzle and the suction source.

The extraction cleaner 10 can include a fluid delivery system 12 for storing cleaning fluid and delivering the cleaning fluid to the surface to be cleaned and a recovery system 14 for removing the spent cleaning fluid and debris from the surface to be cleaned and storing the spent cleaning fluid and debris.

The recovery system 14 can include a suction nozzle 16, a suction source 18 in fluid communication with the suction nozzle 16 for generating a working air stream, and a recovery container 20 for separating and collecting fluid and debris from the working airstream for later disposal. A separator 21 can be formed in a portion of the recovery container 20 for separating fluid and entrained debris from the working airstream.

The suction source 18 can be any suitable suction source and is illustrated herein as a motor/fan assembly 19 which is provided in fluid communication with the recovery container 20. The motor/fan assembly 19 can be electrically coupled to a power source 22, such as a battery or by a power cord plugged into a household electrical outlet. A suction power switch 24 between the motor/fan assembly 19 and the power source 22 can be selectively closed by the user, thereby activating the motor/fan assembly 19. It will be understood that in the example where a battery is utilized as the power source that the extraction cleaner 10 can be considered cordless.

The suction nozzle 16 can be provided on a base or cleaning head adapted to move over the surface to be cleaned. An agitator 26 can be provided adjacent to the suction nozzle 16 for agitating the surface to be cleaned so that the debris is more easily ingested into the suction nozzle 16. Some examples of agitators 26 include, but are not limited to, a horizontally-rotating brushroll, dual horizontally-rotating brushrolls, one or more vertically-rotating brushrolls, or a stationary brush. It will be understood that the agitator(s) 26 can be formed from any suitable material including that a hybrid brushroll can be utilized. A hybrid brushroll includes multiple agitation materials to optimize cleaning performance on different types of surfaces to be cleaned, including hard and soft surfaces, and for different cleaning modes, including wet and dry vacuum cleaning. By way of non-limiting example, a hybrid brushroll can include a plurality of tufted bristles or unitary bristle strips extending from a dowel and microfiber material provided on the dowel, arranged between the bristles.

The fluid delivery system 12 can include at least one fluid container 34 for storing a supply of fluid. The fluid can include one or more of any suitable cleaning fluids, including, but not limited to, water, compositions, concentrated detergent, diluted detergent, etc., and mixtures thereof. For example, the fluid can include a mixture of water and concentrated detergent.

The fluid delivery system 12 can further include a flow control system 36 for controlling the flow of fluid from the container 34 to a fluid distributor 38. In one configuration, the flow control system 36 can include at least one pump 40 which pressurizes the system 12 and a flow control valve 43 which controls the delivery of fluid to the distributor 38. In one example, the pump 40 can be coupled with the power source 22. An actuator 44 can be provided to actuate the flow control system 36 and dispense fluid to the distributor 38. The actuator 44 can be operably coupled to the valve 43 such that pressing the actuator 44 will open the valve 43. The valve 43 can be electrically actuated, such as by providing an electrical switch 46 between the valve 43 and the power source 22 that is selectively closed when the actuator 44 is pressed, thereby powering the valve 43 to move to an open position. In one example, the valve 43 can be a solenoid valve.

It is contemplated that the pump 40 can further include a first pump 41 and a second pump 42 each fluidly coupled to the flow control valve 43. In such a case, operation of the first pump 41 can provide a first volumetric flow rate to the fluid distributor 38, and simultaneous operation of the first and second pumps 41, 42 can provide a second volumetric flow rate to the fluid distributor 38. In another example, each of the first and second pumps 41, 42 can provide differing first and second volumetric flow rates, and simultaneous operation of the pumps 41, 42 can provide a third volumetric flow rate to the fluid distributor 38. In yet another example, either or both of the first and second pumps 41, 42 can be configured to operate with a plurality of volumetric flow rates, such as a "high flow" and a "low flow," where combinations of flow rates can be achieved by single or simultaneous operation of the first and second pumps 41, 42. It is further contemplated that the pumps 41, 42 can be centrifugal pumps or solenoid pumps, in non-limiting examples. In still another example, a single pump 40 can be utilized within the flow control system 36, such as a single centrifugal pump 40 or a single solenoid pump 40.

The fluid distributor 38 can include at least one distributor outlet for delivering fluid to the surface to be cleaned. The at least one distributor outlet can be positioned to deliver fluid directly to the surface to be cleaned, or indirectly by delivering fluid onto the agitator 26. The at least one distributor outlet can include any structure, such as a nozzle or spray tip; multiple distributor outlets can also be provided. As illustrated in FIG. 1, the distributor 38 can include a plurality of distributor outlets 48 which distribute cleaning fluid to the surface to be cleaned. At least one of the distributor outlets 48 can also be selectively operated, such as by a valve (not shown), to distribute additional cleaning fluid. Alternately, the distributor 38 can include a single distributor outlet, such as a single sprayer, as desired. Further, the distributor 38 including the distributor outlets 48 can be positioned on a body 39 that can be removably coupled to the extraction cleaner 10.

Optionally, a heater 50 can be provided for heating the cleaning fluid prior to delivering the cleaning fluid to the surface to be cleaned. In the example illustrated in FIG. 1, an in-line heater 50 can be located downstream of the container 34 and upstream of the pump 40. Other types of heaters 50 can also be used. In yet another example, the cleaning fluid can be heated using exhaust air from a motor-cooling pathway for the motor/fan assembly 19.

As another option, the fluid delivery system can be provided with at least one additional container for storing a cleaning fluid. For example, the container 34 can store water and an additional container 52 can store a cleaning agent such as detergent. The containers 34, 52 can, for example, be defined by a supply tank and/or a collapsible bladder. In one configuration, the container 34 can be a bladder that is provided within the recovery container 20. Alternatively, a single container 34 can define multiple chambers for different fluids.

In the case where multiple containers 34, 52 are provided, the flow control system 36 can further be provided with a mixing system 54 for controlling the composition of the cleaning fluid that is delivered to the surface. The composition of the cleaning fluid can be determined by the ratio of cleaning fluids mixed together by the mixing system. As shown herein, the mixing system 54 includes a mixing manifold 56 that selectively receives fluid from one or both of the containers 34, 52. A mixing valve 58 is fluidly coupled with an outlet of the additional container 52, whereby when mixing valve 58 is open, the second cleaning fluid will flow to the mixing manifold 56. By controlling the orifice of the mixing valve 58 or the time that the mixing valve 58 is open, the composition of the cleaning fluid that is delivered to the surface can be selected.

Optionally, the pump 40 can be eliminated and the flow control system 36 can include a gravity-feed system having a valve fluidly coupled with an outlet of the container(s) 34, 52, whereby when valve is open, fluid will flow under the force of gravity to the distributor 38. The valve can be mechanically actuated or electrically actuated, as described above.

The extraction cleaner 10 shown in FIG. 1 can be used to effectively remove debris and fluid from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps.

In operation, the extraction cleaner 10 is prepared for use by coupling the extraction cleaner 10 to the power source 22, and by filling the container 34, and optionally the additional container 52, with cleaning fluid. Cleaning fluid is selectively delivered to the surface to be cleaned via the fluid delivery system 12 by user-activation of the actuator 44, while the extraction cleaner 10 is moved back and forth over the surface. The agitator 26 can simultaneously agitate the cleaning fluid into the surface to be cleaned. During operation of the recovery system 14, the extraction cleaner 10 draws in fluid and debris-laden working air through the suction nozzle 16 and into the downstream recovery container 20 where the fluid debris is substantially separated from the working air. The airstream then passes through the motor/fan assembly 19 prior to being exhausted from the extraction cleaner 10. The recovery container 20 can be periodically emptied of collected fluid and debris.

Figure 2:
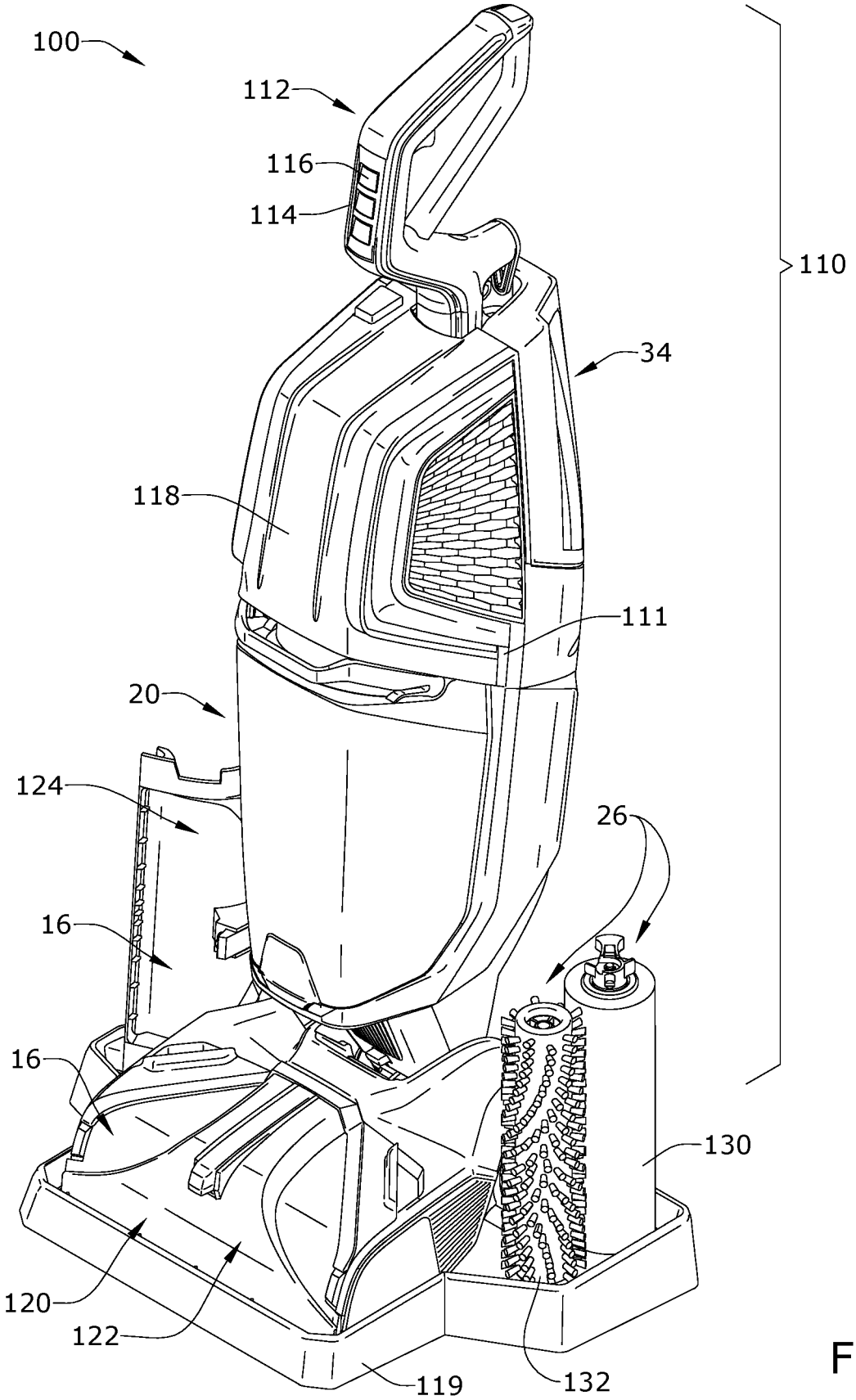
FIG. 2 is a perspective view of the surface cleaning apparatus of FIG. 1 in the form of an upright extraction cleaner having a base assembly with multiple nozzles and agitators according to various aspects described herein.

FIG. 2 is a perspective view illustrating an upright extraction cleaner 100 according to various aspects described herein. For purposes of description related to the figures, the terms "upper," "lower," "right," "left," "rear," "front," "vertical," "horizontal," "inner," "outer," and derivatives thereof shall be described from the perspective of a user behind the upright extraction cleaner 100, which defines the rear of the upright extraction cleaner 100. However, it is to be understood that the disclosure may assume various alternative orientations, except where expressly specified to the contrary.

The upright extraction cleaner 100 can include a housing with an upright assembly 110 and a base assembly 120. The upright assembly 110 can be pivotally connected to the base assembly 120 for directing the base assembly 120 across the surface to be cleaned.

It is contemplated that the upright extraction cleaner 100 can include any or all of the various systems and components described in FIG. 1, including a fluid delivery system 12 for storing and delivering a cleaning fluid to the surface to be cleaned and a recovery system 14 for extracting and storing the dispensed cleaning fluid, dirt and debris from the surface to be cleaned. The various systems and components schematically described for FIG. 1, including the fluid delivery system 12 and fluid recovery system 14 can be supported by either or both the base assembly 120 and the upright assembly 110. Further, in the example of FIG. 2 the fluid delivery system 12 includes first and second pumps 41, 42 as described above.

The upright assembly 110 includes a main support section or frame 111 supporting components of the fluid delivery system 12 and the recovery system 14, including, but not limited to, the recovery container 20, the fluid container 34, and the first and second pumps 41, 42 (FIG. 1). The upright assembly 110 also has an elongated handle 112 extending upwardly from the frame 111. The handle 112 can be in the form of a telescoping handle, and can also be provided with a hand grip 114 at one end that can be used for maneuvering the upright extraction cleaner 100 over a surface to be cleaned. In addition, at least one electronic control 116 is provided on the handle 112 adjacent the hand grip 114 and coupled to the power source 22 (FIG. 1) for selective operation of components of the fluid delivery system 12 or recovery system 14.

A motor housing 118 is formed at an upper end of the frame 111 and contains the motor/fan assembly 19 (FIG. 1) positioned therein in fluid communication with the recovery container 20.

The upright extraction cleaner 100 has one base assembly 120 with a set of interchangeable suction nozzles 16 and a set of interchangeable agitators 26. As used herein, the term "set" or a "set" of elements can be any number of elements, including only one. In the example shown, the set of interchangeable suction nozzles 16 includes multiple, interchangeable suction nozzles 16 in the form of a bare-floor-cleaning nozzle 122 and a carpet-cleaning nozzle 124. Either of these can be mounted on a housing 125 of the base assembly 120 to provide the suction nozzle 16 for the extraction cleaner 100. A tray 119 can provide a docking area for the upright extraction cleaner 100, either or both of the bare-floor-cleaning nozzle 122 and the carpet-cleaning nozzle 124, and interchangeable agitators 26.

In addition to providing the suction nozzle for the extraction cleaner 10, the bare-floor-cleaning nozzle 122 and a carpet-cleaning nozzle 124 can include at least one fluid distributor for the base assembly 120. The bare-floor-cleaning nozzle 122 and a carpet-cleaning nozzle 124 can carry the at least one fluid distributor therewith in a modular or unitary arrangement that is removable as one unit from base housing 125.

In the example shown, the base assembly 120 has multiple, interchangeable agitators in the form of a microfiber brushroll 130 and a bristled brushroll 132. Either of these can be mounted on the housing of the base assembly 120 to provide the agitator for the extraction cleaner 10. In one example, to use the extraction cleaner 100 in a bare-floor cleaning mode, the bare-floor-cleaning nozzle 122 and the microfiber brushroll 130 are installed on the base assembly 120, and to use the extraction cleaner 100 in a carpet-cleaning mode, the carpet-cleaning nozzle 124 and the bristled brushroll 132 are installed on the base assembly 120. It is also contemplated that the nozzles and brushrolls may be used in other combinations. Further still, while they have been descriptively defined, it will be understood that the carpet-cleaning nozzle 124 can be utilized on a bare floor and that the bare-floor-cleaning nozzle 122 can be utilized on carpet.

Figure 3:
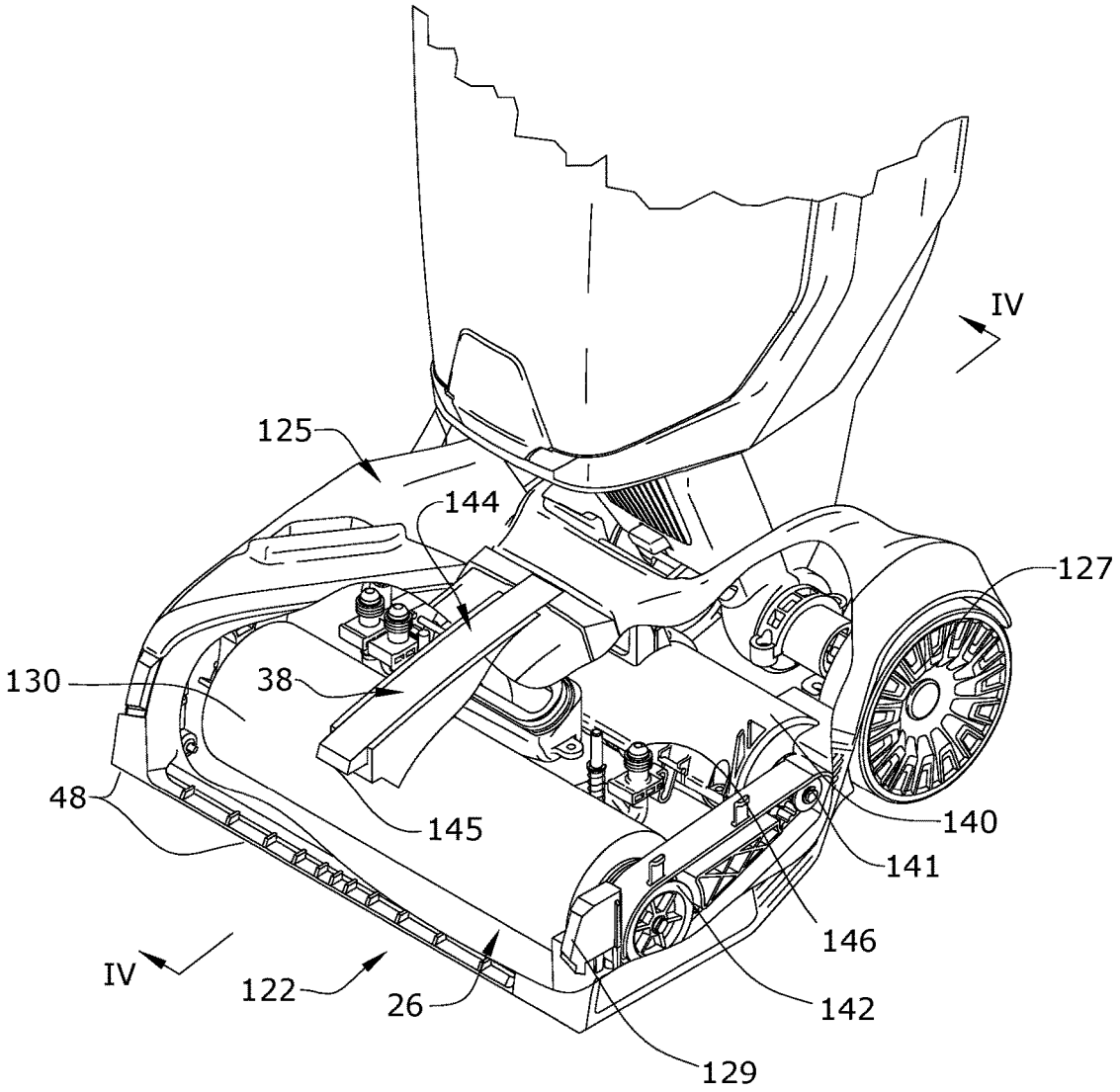
FIG. 3 is a perspective cutaway view of the upright extraction cleaner and base assembly of FIG. 2 in a bare-floor-cleaning configuration according to various aspects described herein.

FIG. 3 is a perspective cutaway view of the upright extraction cleaner 100 configured for bare floor cleaning. A cutaway view of the bare-floor-cleaning nozzle 122 is shown, where the bare-floor cleaning nozzle 122 includes the base housing 125 supporting components of the fluid delivery system 12 and the recovery system 14, including, but not limited to, the suction nozzle 16, the agitator 26, and the fluid distributor 38. Wheels 127 at least partially support the base housing 125 for movement over the surface to be cleaned.

The fluid distributor 38 can include a conduit 143 that supplies cleaning fluid from the fluid container 34 (FIG. 2) to a base distributor 144 positioned above the base housing 125 and terminating in a base nozzle which is illustrated as a base outlet 145 as shown. In addition, light sources such as light-emitting diodes (LEDs) 129 can be positioned within the base housing 125 as indicators for various operations of the upright extraction cleaner 100. In one example, the LEDs 129 can illuminate, either in a steady state or flashing pattern, when liquid is distributed through the base distributor 144.

The agitator 26 of the illustrated example includes an exemplary horizontally-rotating brushroll, such as the microfiber brushroll 130, operatively coupled to a drive shaft 141 of an agitator motor 140 via a transmission 142, which can include one or more belts, gears, shafts, pulleys, or combinations thereof. The first and second pumps 41, 42 (FIG. 1) may also be operatively coupled with the drive shaft 141 via the transmission 142, or optionally via its own transmission. The exemplary brushroll can include a variety of brushroll types, and in the illustrated example of FIG. 3 the exemplary brushroll includes a microfiber brushroll 130.

It is contemplated that either of the agitator 26 or the suction nozzle 16 can be configured to be removable as a unit from the bare-floor-cleaning nozzle 122. In such a case, the agitator 26 or suction nozzle 16 can include locating features such as keys to prevent misassembly, or to prevent the assembly of undesirable combinations of components (e.g. a bare-floor-cleaning suction nozzle with a carpet-cleaning brushroll).

Figure 4:
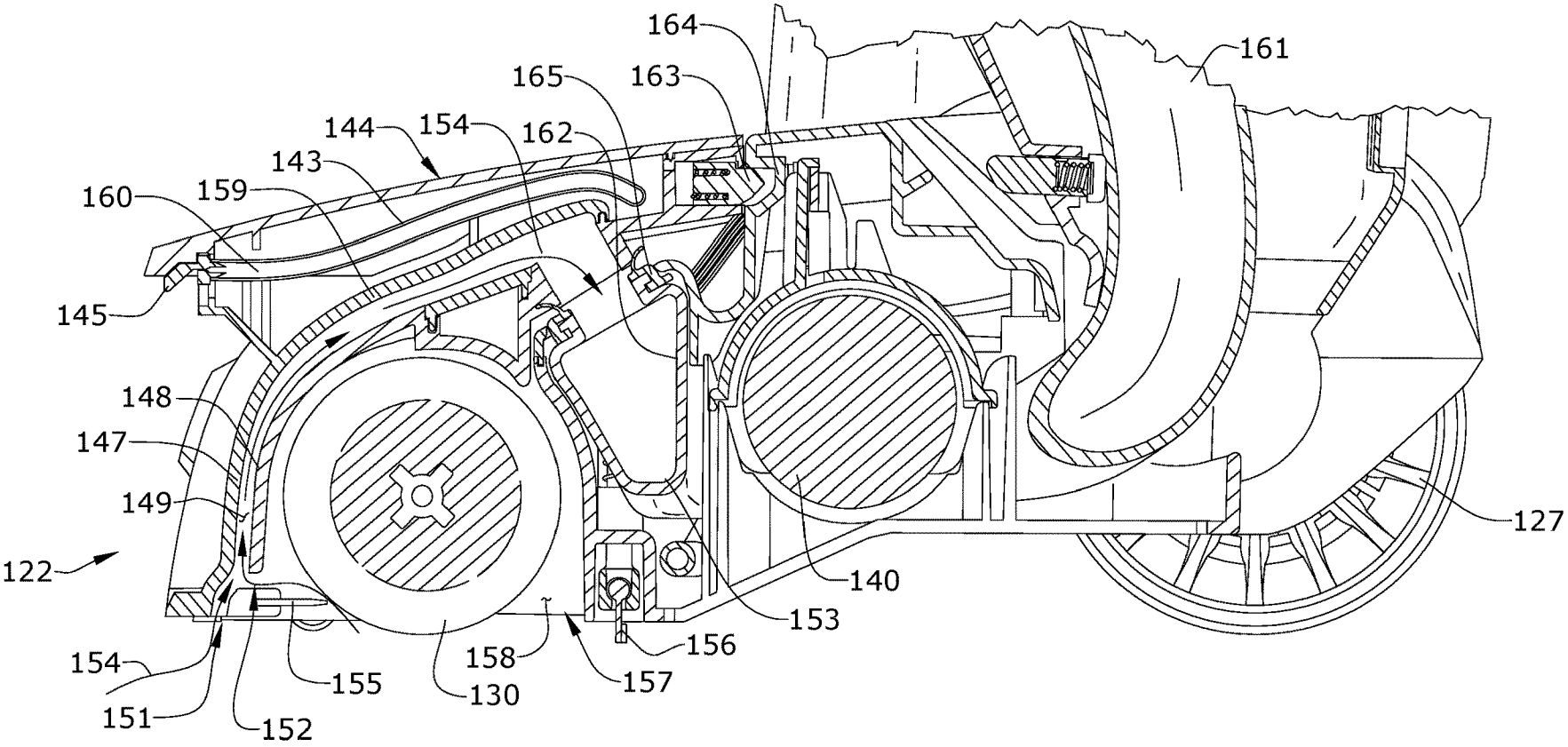
FIG. 4 is a cross-sectional view of the base assembly of FIG. 3 along line IV-IV.

FIG. 4 illustrates a cross-sectional view of the base assembly 120, with the bare-floor-cleaning nozzle 122 and the microfiber brushroll 130 installed on the base assembly 120. The distributor outlets 48 are adapted to dispense cleaning fluid within the base housing 125 in front of the microfiber brushroll 130. The base outlet 145 can dispense cleaning fluid in front of the base housing 125 as shown. The conduit 143 can extend from the bare-floor-cleaning nozzle 122 to the fluid container 34 in the upright assembly 110, and may be made up of one or more flexible and/or rigid sections. Either or both of the pumps 41, 42 (FIG. 1) can form a portion of the conduit 143.

A front wall 147 and a central wall 148 can form portions of the suction nozzle 16. A suction pathway 149 can be defined between the front and central walls 147, 148, with an opening therebetween forming a first suction nozzle inlet 151 spaced from the surface to be cleaned, for example by 3-5 mm. The suction pathway 149 is in fluid communication with a recovery airflow conduit 153 leading to the recovery container 20.

In addition, a horizontal wiper 155 can be positioned adjacent to, and in front of, the microfiber brushroll 130 to define a second suction nozzle inlet 152 to the suction pathway 149. In the illustrated example the horizontal wiper 155 has sufficient length to extend toward, and contact, the microfiber brushroll 130. It is also contemplated that the horizontal wiper 155 can be spaced apart from the microfiber brushroll 130. In such a case, the microfiber brushroll 130 can centrifugally expand during operation of the upright extraction cleaner 100 and contact the horizontal wiper 155 in its expanded state. In this manner, excess liquid or debris from the microfiber brushroll 130 can be collected by the wiper 155 and directed to the second suction nozzle inlet 152 to be deposited in the recovery container 20 (FIG. 1). A squeegee blade 156 can also be included in the bare-floor-cleaning nozzle 122. The squeegee blade 156 is illustrated as being positioned rearward of the microfiber brushroll 130 to further remove excess liquid from the surface to be cleaned.

An agitator housing 157 can be at least partially defined by the central wall 148 and define an agitator chamber 158 for the agitator 26. In addition, the front wall 147 can form an enclosure 159 for a fluid pathway 160 to the base outlet 145.

The recovery airflow conduit 153 may be made up of one or more flexible and/or rigid sections, including a hose conduit 161 that passes from the bare-floor-cleaning nozzle 122 to the upright assembly 110. The hose conduit 161 can be flexible to facilitate pivoting movement of the upright assembly 110 relative to the bare-floor-cleaning nozzle 122.

A portion of the agitator housing 157 may be molded to form a portion of the recovery airflow conduit 153. Here, the agitator housing 157 includes a rigid duct 162 at the rear of the housing 157, rearward of the agitator chamber 158. A seal 165 can be positioned between the rigid duct 162 and the suction pathway 149 to fluidly isolate the recovery airflow conduit 153 from surrounding components such as the agitator motor 140. Arrows 154 illustrate the flow of air, debris, and extracted fluid moving through the first and second suction nozzle inlets 151, 152 to the recovery airflow conduit 153. In addition, the bare-floor-cleaning nozzle 122 can be configured to be removable from the upright extraction cleaner 100. In the illustrated example, the bare-floor-cleaning nozzle 122 can further include a latch 163 configured to couple with a catch 164 on the upright extraction cleaner 100.

Figure 5:
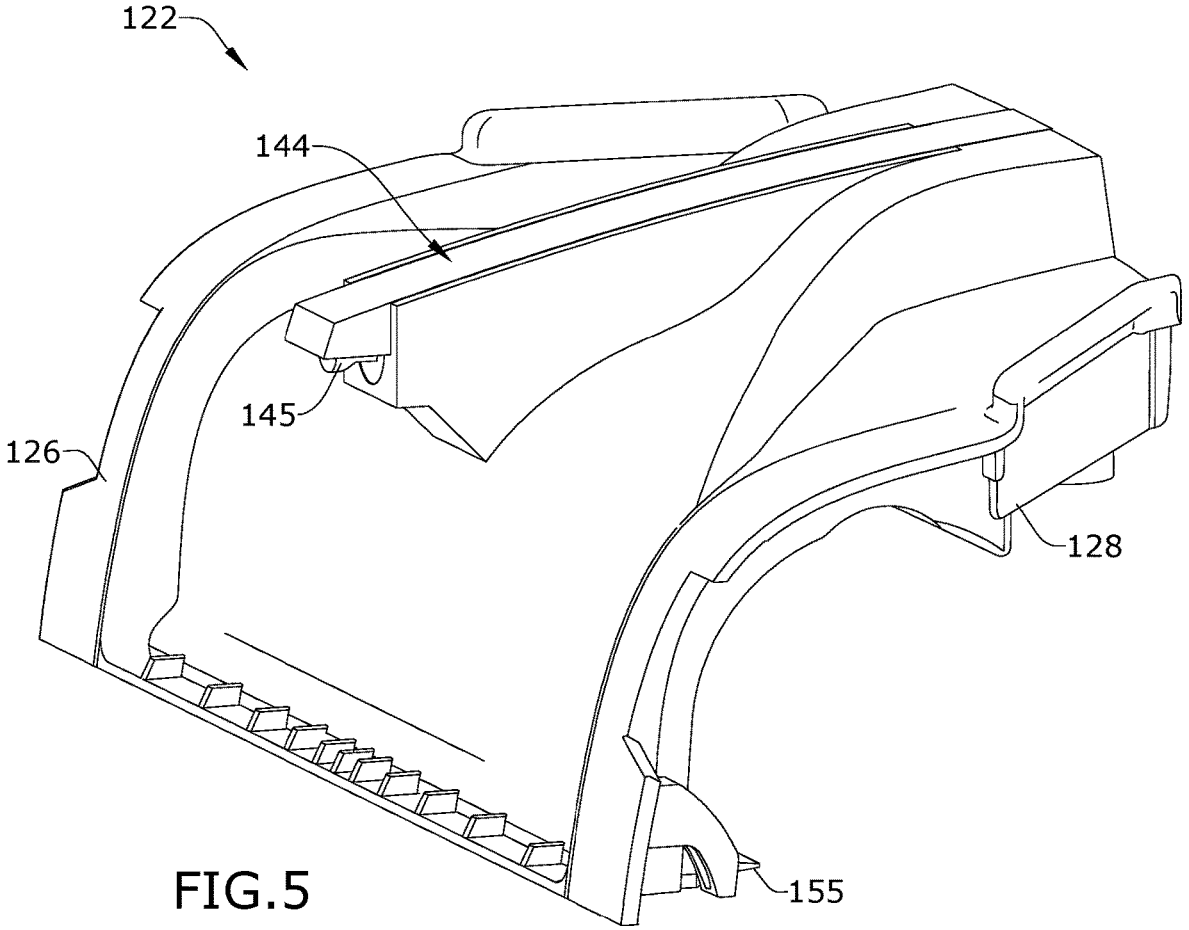
FIG. 5 is a front perspective view of a nozzle assembly for the base assembly of FIG. 3.

FIG. 5 illustrates the bare-floor suction nozzle 122. It is contemplated that the bare-floor suction nozzle 122 can include an outer nozzle housing 126 coupled to an inner nozzle housing 128. The horizontal wiper 155, base distributor 144, and base outlet 145 can be coupled to the inner nozzle housing 128.

Figure 6:
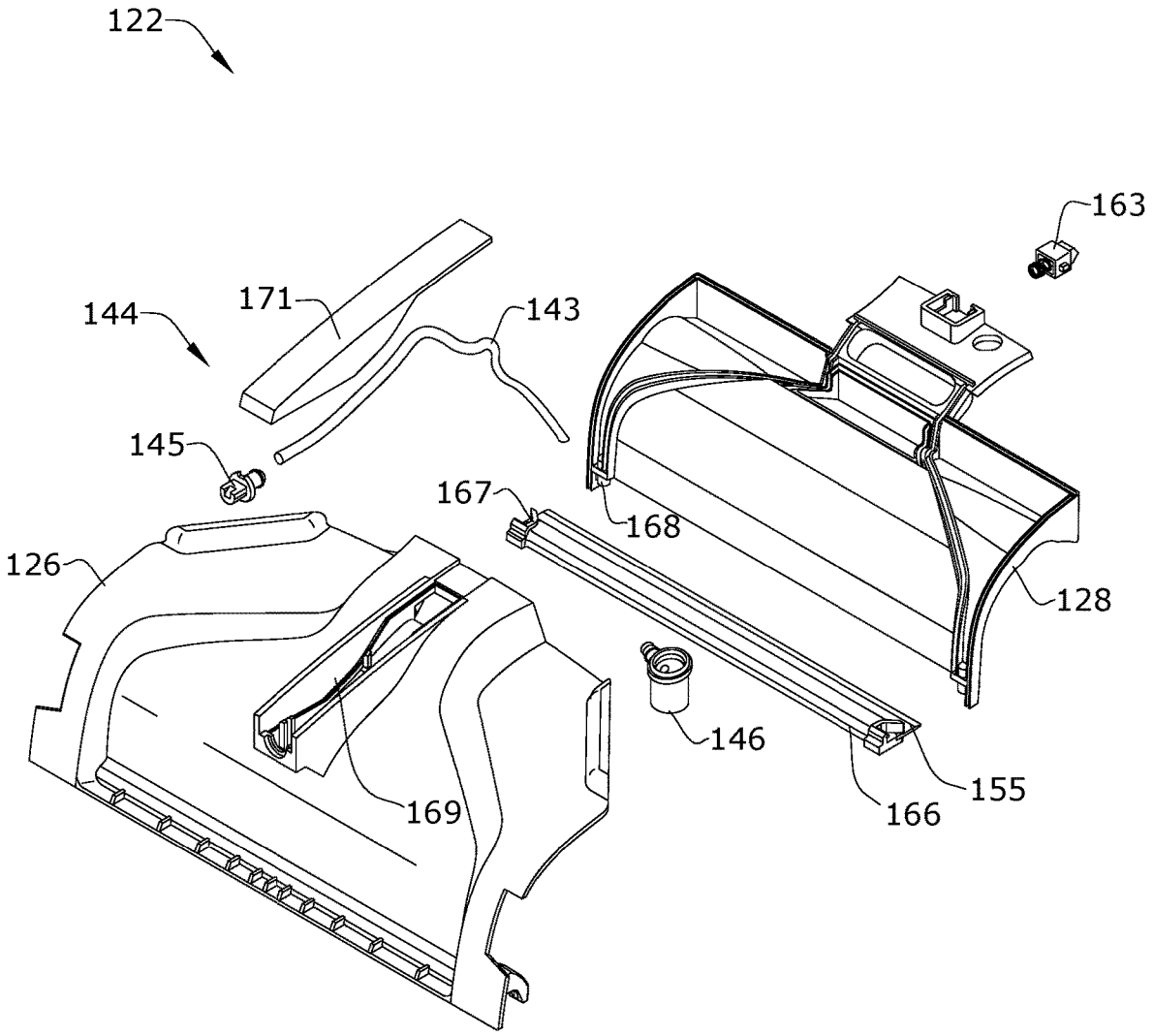
FIG. 6 is an exploded view of the nozzle assembly of FIG. 5.

Additional details of the bare-floor suction nozzle 122 are illustrated in the partially-exploded view of FIG. 6. The horizontal wiper 155 can be carried by a wiper housing 166 and couple to the inner nozzle housing 128 via first couplings 167 on the wiper housing 166 and second couplings 168 on the inner nozzle housing 128. The conduit 143 can be fluidly coupled to a base distributor fluid coupling 146 and the base outlet 145 for the supply of cleaning fluid to the base outlet 145 from the fluid container 34 (FIG. 1). A portion of the conduit 143 can be positioned along a channel 169 within the outer nozzle housing 126 and housed beneath a cover 171 to at least partially define the base distributor 144. In addition, the latch 163 can be coupled to the inner nozzle housing 128 to provide for selective coupling with the upright extraction cleaner 100 (FIG. 4).

Figure 7:
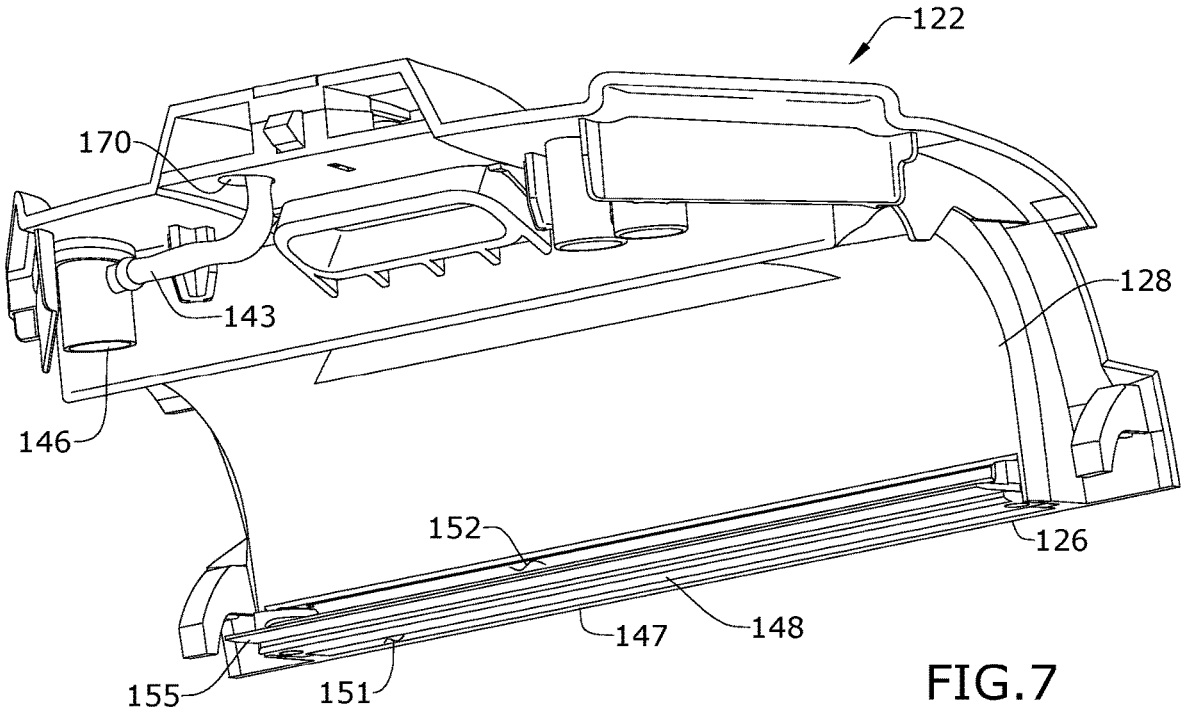
FIG. 7 is a rear perspective view of the nozzle assembly of FIG. 5.

A rear view of the assembled bare-floor suction nozzle 122 is shown for clarity in FIG. 7, where the first and second suction nozzle inlets 151, 152 are illustrated adjacent the horizontal wiper 155. The conduit 143 can extend from the base distributor fluid coupling 146 through an aperture 170 in the inner nozzle housing 128 and extend through the channel 169 beneath the cover 171. The front wall 147 of the outer nozzle housing 126 and central wall 148 of the inner nozzle housing 128 together can define the first suction nozzle inlet 151 to the suction pathway 149 (FIG. 4). The second suction nozzle inlet 152 is also visible adjacent the horizontal wiper 155.

Figure 8:
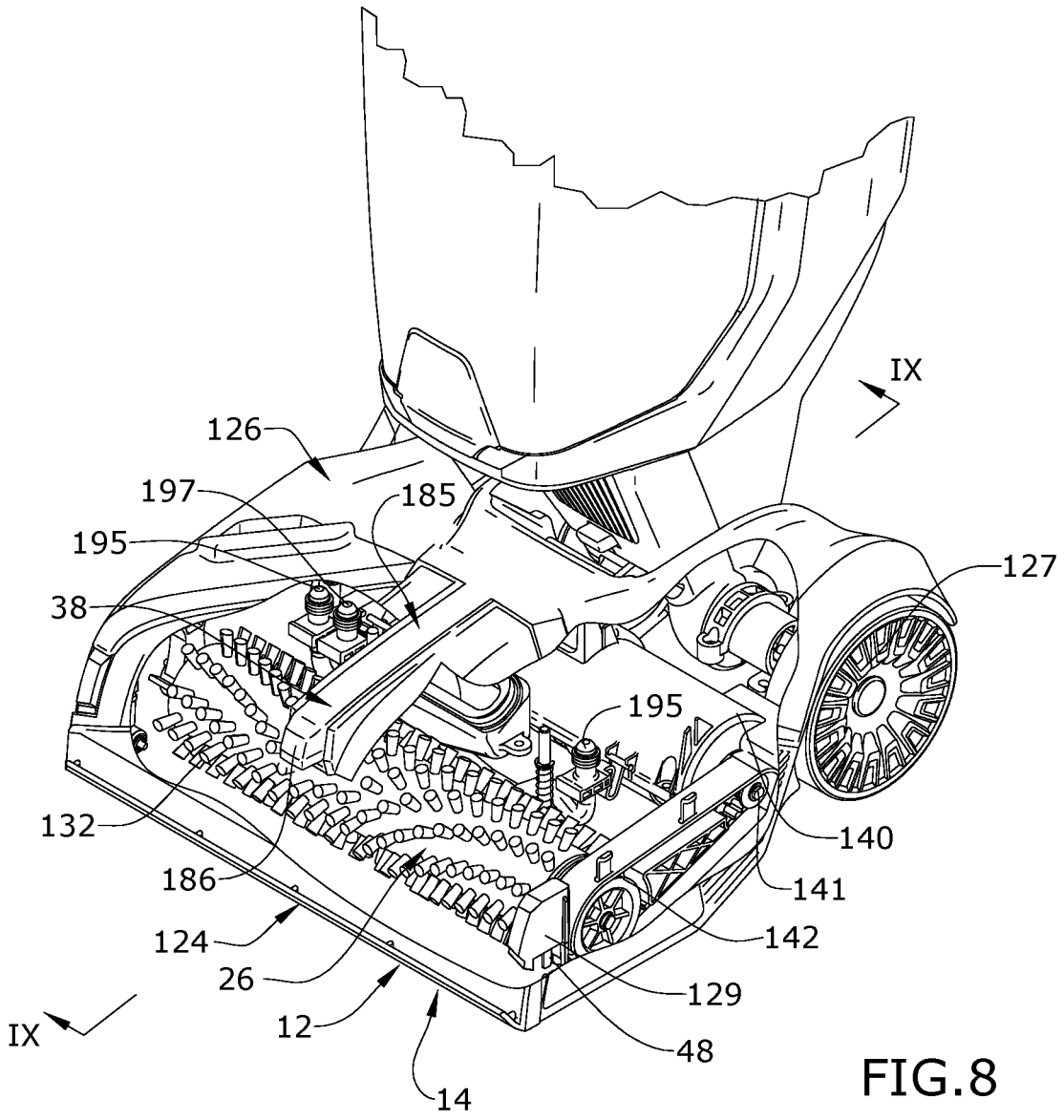
FIG. 8 is a perspective cutaway view of the upright extraction cleaner and base assembly of FIG. 2 in a carpet-cleaning configuration according to various aspects described herein.

FIG. 8 illustrates a cutaway view of the upright extraction cleaner 100 configured for carpet cleaning. The carpet-cleaning nozzle 124 is similar to the bare-floor-cleaning nozzle 122 and it will be understood that they are readily interchangeable by a user. One difference is that the carpet-cleaning nozzle 124 includes the bristled brushroll 132 to lift debris from a carpeted surface.

Figure 9:
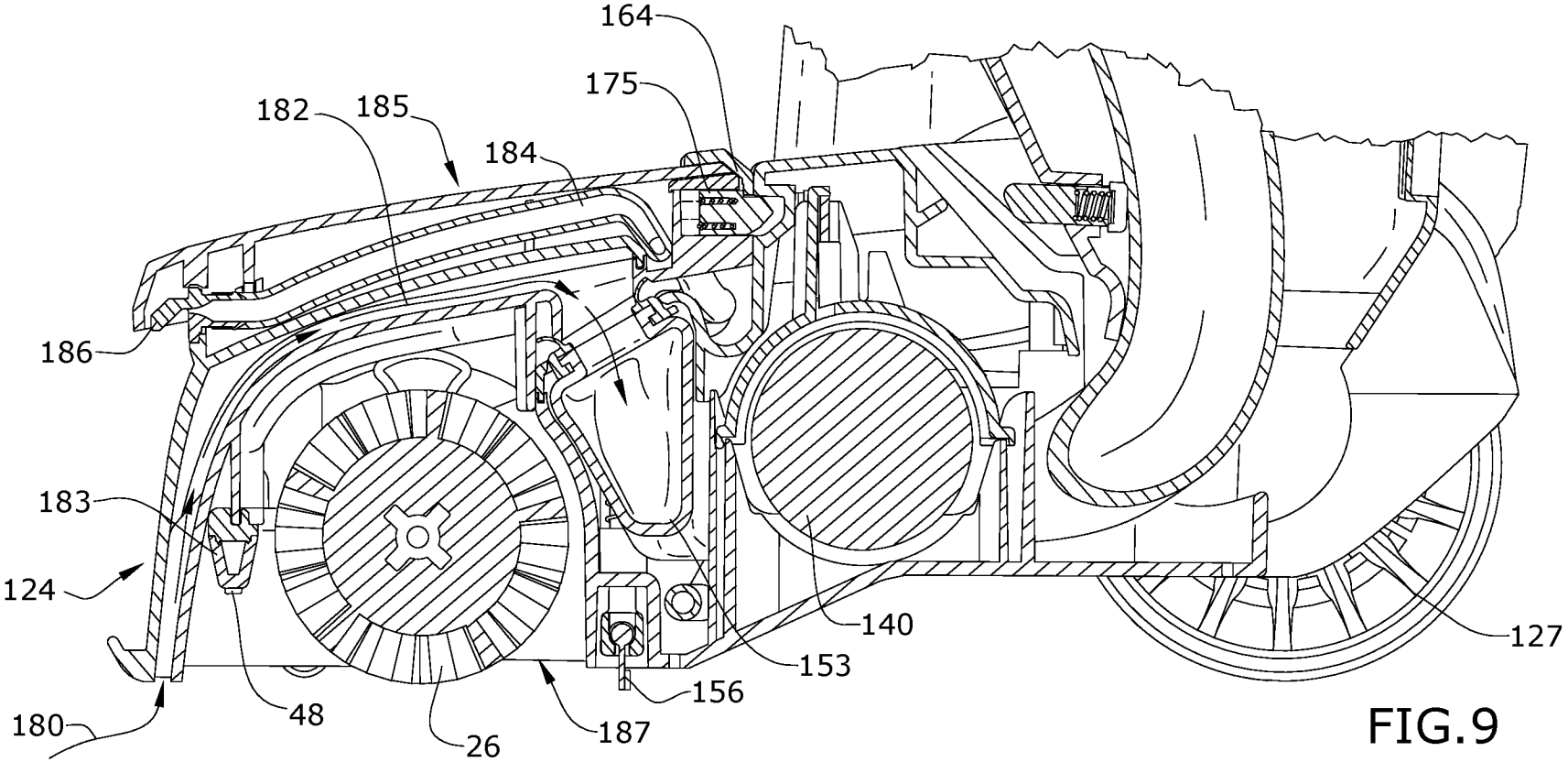
FIG. 9 is a cross-sectional view of the base assembly of FIG. 8 along line IX-IX.

FIG. 9 illustrates a cross-sectional view of the base assembly 120, with the carpet-cleaning nozzle 124 and the bristled brushroll 132 installed on the base assembly 120. The carpet-cleaning nozzle 124 includes a single suction nozzle inlet 180 coupled to the recovery tank 20 (FIG. 1) via the recovery airflow conduit 153. Arrows 182 illustrate the flow of air, debris, and extracted fluid moving through the single suction nozzle inlet 180 to the recovery airflow conduit 153. The suction nozzle inlet 180 can be configured to engage the carpeted surface during operation. Such engagement can extract debris or excess liquid from carpet fibers along the carpeted surface. Optionally, the squeegee blade 156 can also be utilized in the base assembly 120 in the carpet-cleaning configuration. In addition, a latch 175 can be coupled to the carpet-cleaning nozzle 124 for selective coupling with the catch 164 in the base assembly 120.

The carpet-cleaning nozzle 124 is adapted to selectively dispense cleaning fluid in multiple locations, including within the agitator chamber defined by the agitator housing 187, in front of the agitator 26, as well as in front of the base housing 125 forwardly of the suction nozzle inlet 180. The carpet-cleaning nozzle 124 can include a spray bar 183 mounted within a forward portion of the agitator housing 187 and having a plurality of distributor outlets 48 as well as a base distributor 185 having a base outlet 186 positioned above and in front of an agitator housing 187 as shown. One or more conduits can supply cleaning fluid from the flow control system 36 to the spray bar 183 and distributor outlets 48, as well as to the base distributor 185 and base outlet 186. The spray bar 183 can be mounted within the agitator housing 187. A portion of the agitator housing 187 may form a portion of a conduit that supplies cleaning fluid from the fluid container 34 to the spray bar 183 or base outlet 186. In the illustrated example, at least one spray bar conduit 188 (FIG. 11) can supply cleaning fluid to the spray bar 183 and conduit 184 supplies cleaning fluid to the base outlet 186.

Figure 10:
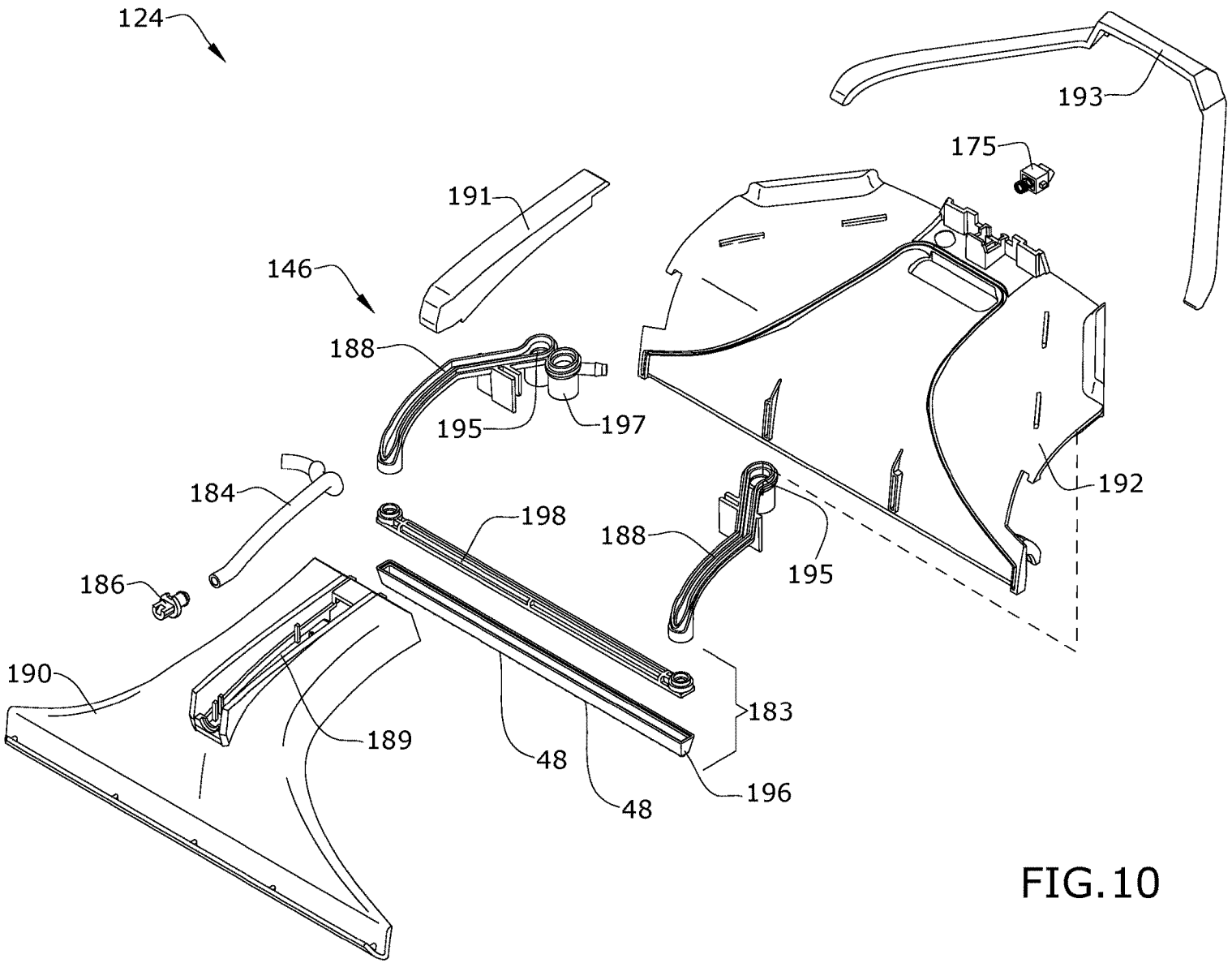
FIG. 10 is an exploded view of a nozzle assembly for the base assembly of FIG. 8.

FIG. 10 illustrates an exploded view of the carpet suction nozzle 124. The carpet suction nozzle 124 can include an inner nozzle housing 192 coupled to the outer nozzle housing 190. The latch 175 can be coupled to the inner nozzle housing 192, and conduit 184 can be positioned within a channel 189 in the outer nozzle housing 190.

Fluid to the spray bar 183 can be supplied by two spray bar conduits 188 which are sealingly mounted to underside of inner nozzle housing 192 to form a sealed supply conduit to spray bar 183. In one example, the spray bar conduits 188 can be sonic welded to the underside of the nozzle housing 192 to form a hermetic seal therebetween. The spray bar conduits 188 are fluidly coupled to the upstream portion of the fluid delivery system 12 via spray bar fluid couplings 195. In addition, the spray bar 183 can include a spray bar cover 198 sealingly mounted to a spray bar reservoir 196, wherein the distributor outlets 48 can be formed in a bottom wall of the spray bar reservoir 196. In one example, the spray bar cover 198 can be sonic welded to the reservoir 196 to form a hermetic seal therebetween. The conduit 184 supplying the base distributor 185 and base outlet 186 can be fluidly coupled to a base distributor fluid coupling 197. In this manner, the conduit 184 and spray bar conduits 188 can be fluidly coupled to the fluid supply container 34 (FIG. 1) to selectively deliver cleaning fluid to the distributor outlets 48 or the base outlet 186.

Figure 11:
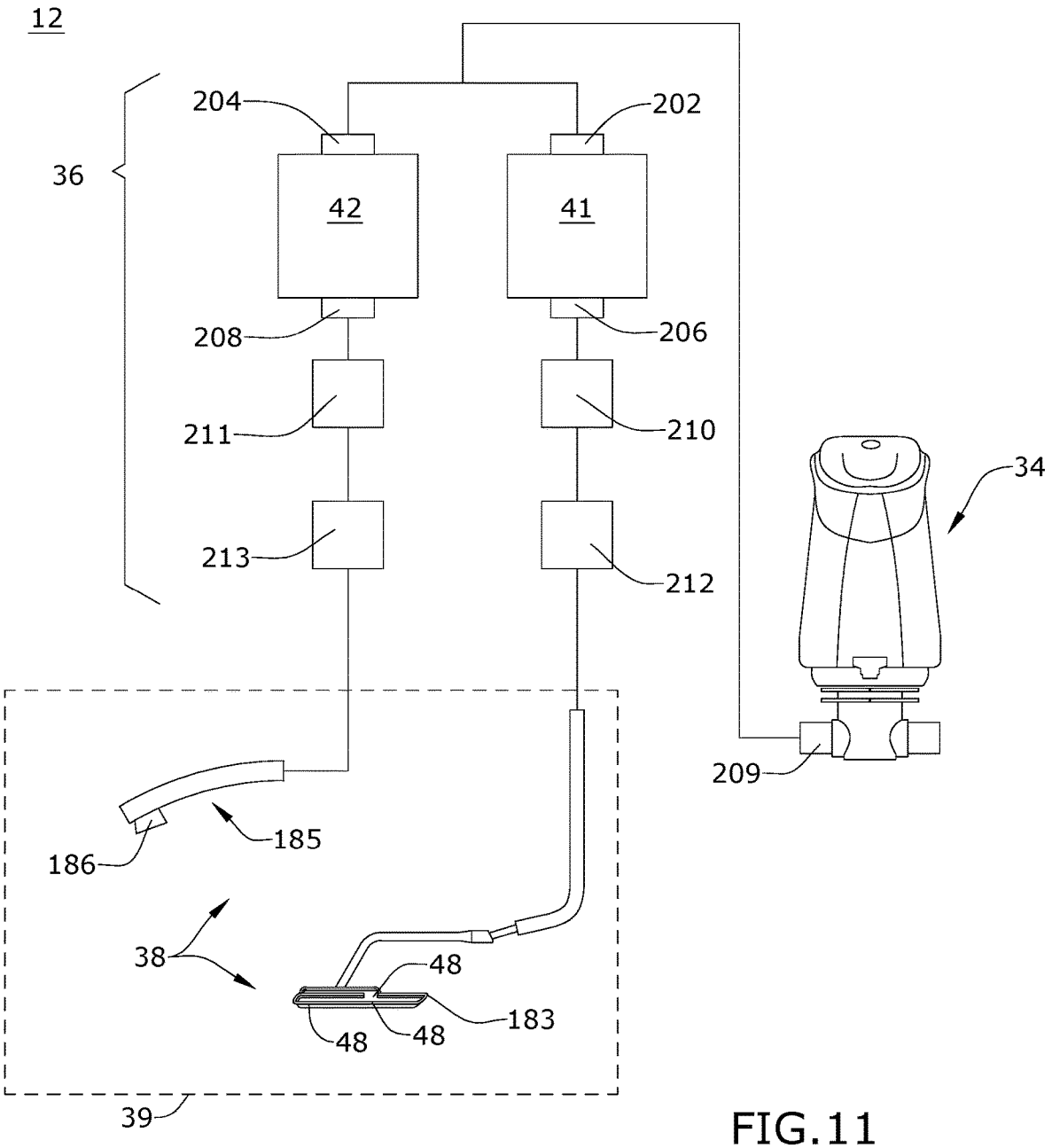
FIG. 11 is a schematic view of a fluid delivery system that can be utilized in the upright extraction cleaner of FIG. 2 according to various aspects described herein.

FIG. 11 is a schematic view of the fluid delivery system 12 of the upright extraction cleaner 100 (FIG. 2), which can be utilized with both the carpet-cleaning nozzle 124 and bare-floor-cleaning nozzle 122. For clarity, the fluid delivery system 12 will be discussed with respect to the carpet-cleaning nozzle 124.

Each of the first and second pumps 41, 42 include respective inlets 202, 204 and respective outlets 206, 208. An outlet 209 of the fluid container 34 is fluidly coupled to the inlets 202, 204 of the respective first and second pumps 41, 42, such as via a Y-valve (not shown). In the illustrated example the outlet 206 of the first pump 41 is coupled to a conduit feeding the spray bar 183. More specifically, a valve 210 and a flow controller 212 are configured to vary the flow rate of cleaning fluid to the spray bar 183 and through the outlets 48 onto the surface to be cleaned. In addition, the outlet 208 of the second pump 42 can be coupled to a conduit feeding the base distributor 185. A second valve 211 and second flow controller 213 can also be configured to vary the flow rate of cleaning fluid to the base distributor 185 and through base outlet 186 onto the surface to be cleaned. It is further contemplated that the flow controller 212 can permit "on/off" flow rates wherein a given flow rate is provided at a steady volumetric flow rate or provides no flow through a given distributor. It can be appreciated that the airflow and fluid delivery systems of the upright extraction cleaner 100 can thus be placed in selective communication with the suction nozzle 16 (FIG. 3) or fluid distributor 38 by a user of the upright extraction cleaner 100. In addition, the distributor 38 including the spray bar 183 and base distributor 185 can be positioned on the removable body 39 as indicated.

In one non-limiting example, the first pump 41 can be configured to provide a first "high flow" volumetric flow rate and a second "low flow" volumetric flow rate of cleaning fluid to the spray bar 183. The second pump 42 can be configured to provide a third volumetric flow rate of cleaning fluid to the base distributor 185 and operated in an "on" or "off" mode. In non-limiting examples, the first pump 41 can be operated in a "high flow" mode with the second pump 42 "off" to generate a first overall flow rate. The first pump 41 can be in a "low flow" mode with the second pump 42 "off" to generate a second flow rate. The first pump 41 can be in a "low flow" mode while the second pump 42 is "off" to generate a third flow rate. The first pump can be in a "low flow" mode while the second pump 42 is "on" to generate a fourth flow rate. In this manner the pumps 41, 42 can provide at least three flow rates within the fluid delivery system 12.

In another non-limiting example, the second pump 42 can be fluidly coupled to both the spray bar 183 and base distributor 185. In this example, it is further contemplated that each of the first and second pumps 41, 42 can be configured to provide a first "high flow," and a second "low flow," volumetric flow rate. The first pump 41 can supply cleaning fluid to the spray bar 183 at a "high flow" or "low flow" when operated. The second pump 42 can supply additional cleaning fluid at a "high flow" or "low flow" to both the spray bar 183 and base distributor 185 when operated, such as via a flow selector valve (not shown). In this manner, the pumps 41, 42 can provide multiple flow rates to each of the spray bar 183 and the base distributor 185.

Figure 12:
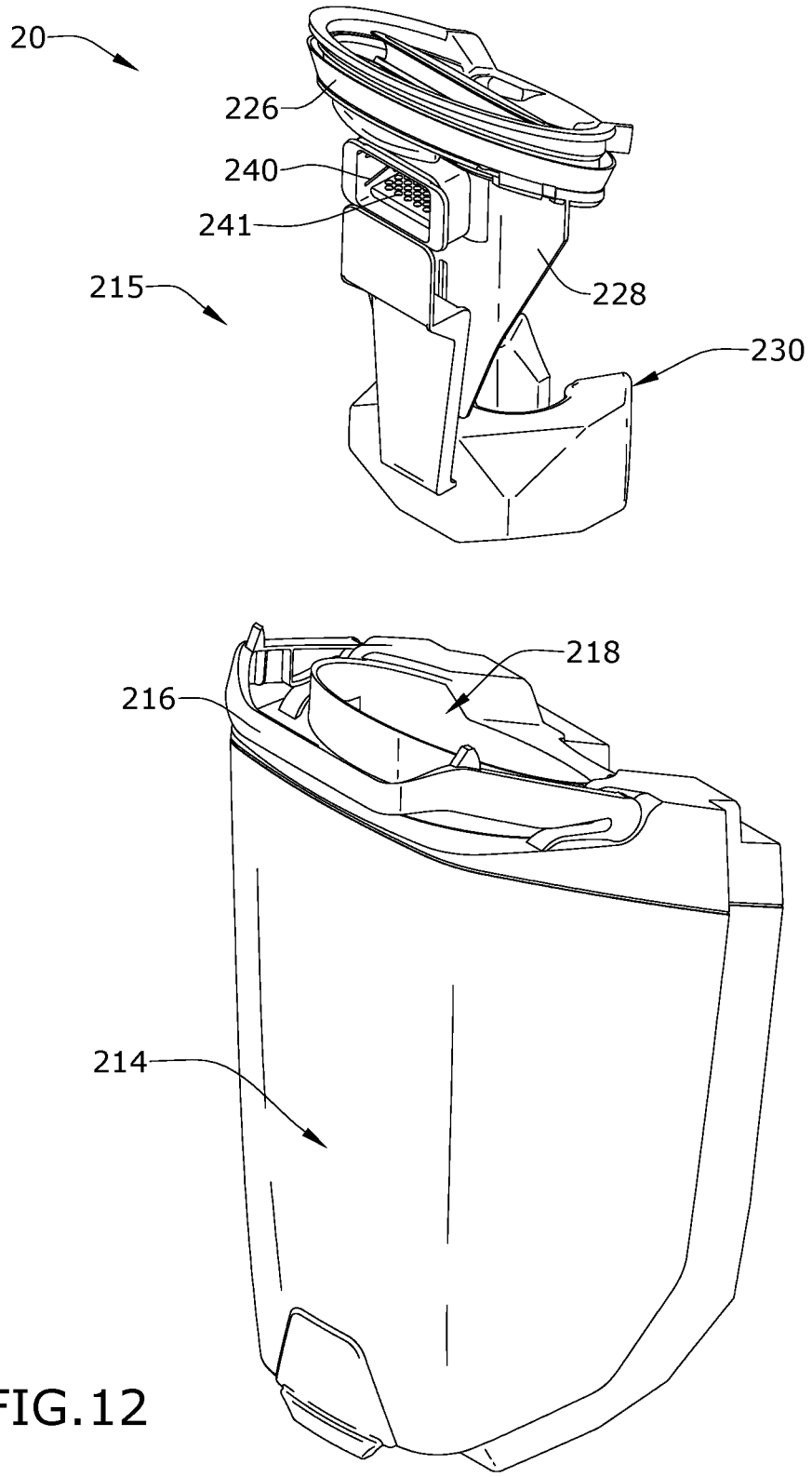
FIG. 12 is a partially exploded perspective side view of a recovery container of the extraction cleaner of FIG. 2.

FIG. 12 is a partially exploded, side view of the recovery container 20. The recovery container 20 can include a recovery tank 214 defining a recovery chamber, and an air/liquid separator assembly 215 within the recovery chamber. At least a portion of the recovery tank 214 can be formed of a transparent or tinted translucent material, which permits a user to view the contents of the recovery tank 214. A handle 216 can be provided on the recovery tank 214 or selectively operably coupled thereto. The handle 216 facilitates removing and carrying the recovery tank 214. The handle 216 can be pivotally coupled to the recovery tank 214 and can be provided near the top of the tank 214, although other locations are possible.

The recovery tank 214 has an opening 218 through which the air/liquid separator 215 is inserted into and removed from the recovery chamber. The opening 218 can be provided on an upper portion of the recovery tank 214, such that the air/liquid separator 215 is inserted through the opening 218. The recovery tank 214 can be provided with a separate opening for emptying such that the air/liquid separator 215 does not have to be removed every time the recovery tank 214 is emptied.

The air/liquid separator 215 is configured to be easily removable from the recovery tank 214 by a user. This permits the air/liquid separator 215 to be disassembled and cleaned more thoroughly as needed. A seal 226 provides a fluid-tight interface between the recovery tank 214 and the and the air/liquid separator 215 when the air/liquid separator 215 is mounted within the recovery chamber, and also prevents the recovery tank 214 from leaking when removed from the upright assembly 110.

The air/liquid separator 215 includes a stack 228 for guiding air and liquid through the recovery tank 214 and a float assembly 230 for selectively closing the suction path through the recovery tank 214. The stack 228 can receive recovered air and liquid from the suction nozzle 16, separate liquid and debris from the working air, and pass substantially clean air, and substantially no liquid, to the motor/fan assembly 19 (FIG. 1). An air inlet port 240 can be provided at an upper end of the stack 228. A screen 241 can be positioned over the air inlet port 240 to prevent debris from entering the port 240 during operation. The screen 241 can filter and collect debris, such as hair, lint, and the like, from the working air stream for later disposal when the tank 214 is emptied.

Figure 13:
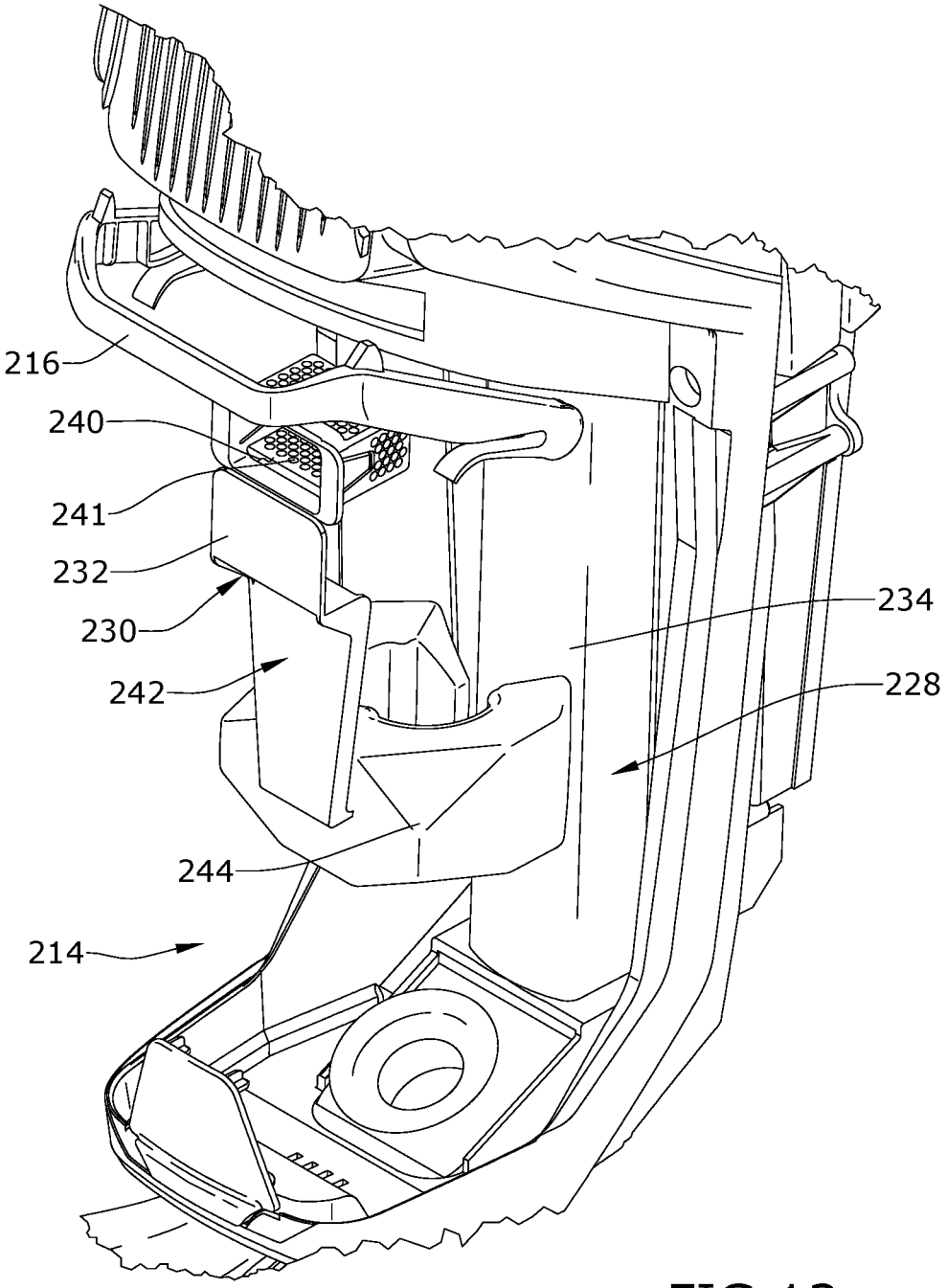
FIG. 13 is a perspective view of a portion of the extraction cleaner of FIG. 2 illustrating a float valve according to various aspects described herein.

FIG. 13 illustrates the float assembly 230 assembled within the recovery tank 214. The float assembly 230 can further include a float shutter 242 and a buoyant float body 244 coupled with the float shutter 242. The float shutter 242 includes a blocker portion 232 that can close the air inlet port 240. The float shutter 242 is slidably coupled to a guide passage 234 on the stack 228, and the float body 244 floats within the recovery tank 214. As the liquid level rises within the recovery tank 214, the float body 244 can raise the float shutter 242 upward. When the liquid level reaches a predetermined maximum level, the blocker portion 232 of the float shutter 242 closes the air inlet port 240, thereby preventing liquid from exiting the recovery tank 214 (FIG. 7) and entering the motor/fan assembly 19 (FIG. 1).

It will be understood that the upright extraction cleaner 100 can include other components for cleaning operations not explicitly illustrated, and such components will not be described herein except as necessary for a complete understanding of the disclosure. For example, the upright extraction cleaner 100 can have similar features to that described in US Patent Application Publication No. 2017/0071434, published Mar. 16, 2017, which is incorporated herein by reference in its entirety.

Figure 14:
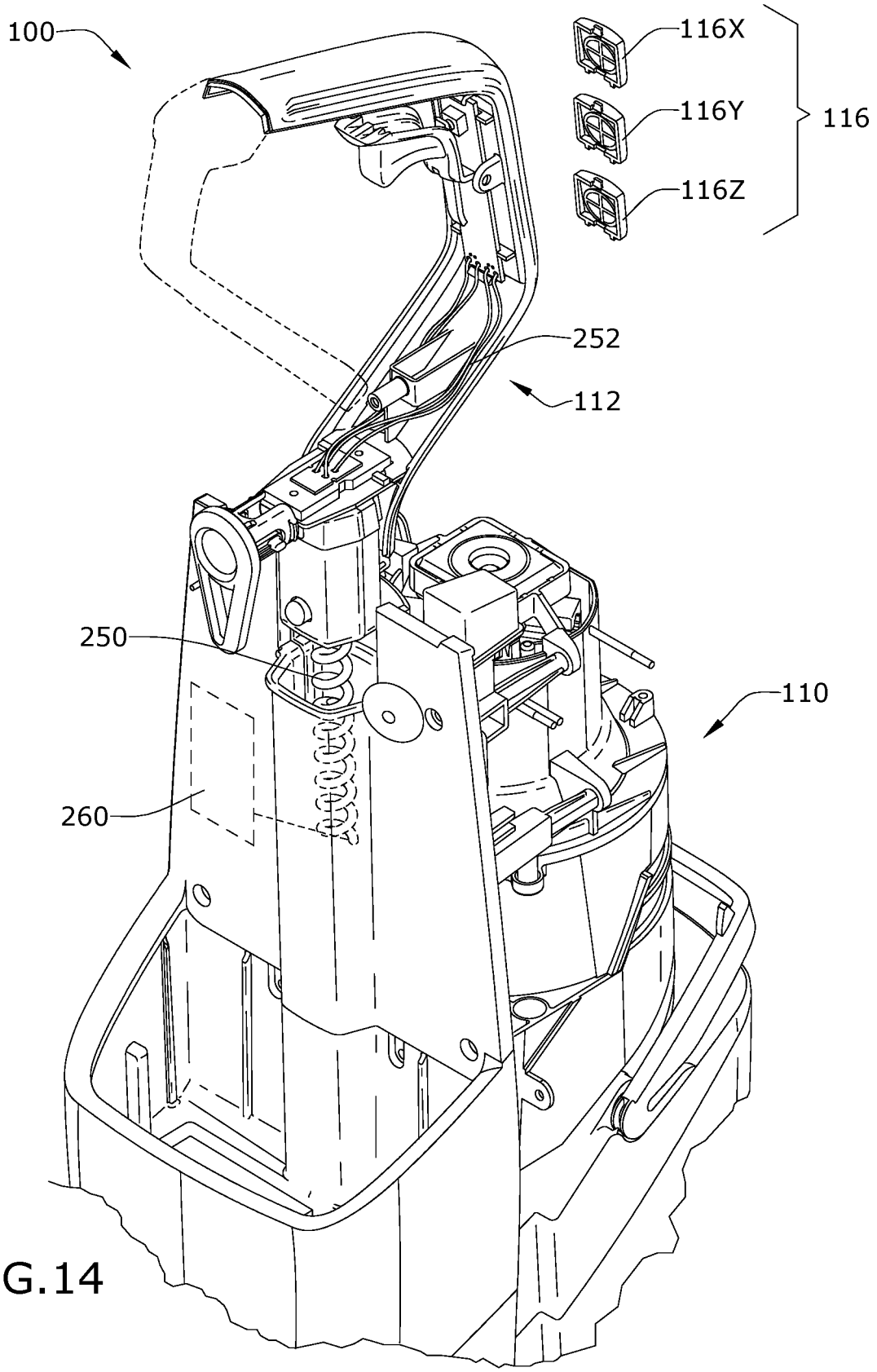
FIG. 14 is a perspective view of a portion of the upright extraction cleaner of FIG. 2 including electrical components according to various aspects described herein.

FIG. 14 more clearly illustrates that the telescoping handle 112 can include a coiled electrical cable 250 stored internally within the upright assembly 110, where the coiled cable 250 can uncoil and extend in length during telescoping upward motion of the handle 112. The coiled cable 250 can connect to wiring 252 within the handle 112 that extends to the at least one electronic control 116 described in FIG. 2. In addition, a circuit board 260 within the upright assembly 110 can be electronically connected to the coiled cable 250 and can also be electronically connected to the power source 22 (FIG. 1). Optionally, the wiring 252 can connect directly to the circuit board 260.

It is further contemplated that the electronic control 116 of the handle 112 can be connected to the wiring 252 and additionally include first, second, and third electronic controls 116X, 116Y, 116Z. During operation of the upright extraction cleaner 100, a user can select the at least one electronic control 116 for selective operation of various components within the fluid delivery system 12 or recovery system 14 (FIG. 1). In a non-limiting example, the first electronic control 116X can be in the form of a general "power on/power off" switch for the upright extraction cleaner 100. The second electronic control 116Y can switch between "high flow" and "low flow" states for the first pump 41 as described above, and the third electronic control 116Z can switch between "flow on" and "flow off" states for the second pump 42 (FIG. 1) as described above. In other non-limiting examples, the at least one electronic control 116 can vary agitation speeds of the agitator 26 (FIG. 2), or vary fan speed of the motor/fan assembly 19 to adjust the level of suction at the suction nozzle 16. It should be understood that the at least one electronic control 116 can be in a variety of forms, non-limiting examples of which include a toggle switch, rocker switch, push button, or touchscreen or touchpad. It is further contemplated that indicator lights may also be provided with, or adjacent, the at least one electronic control 116, such as an LED, or illuminated text such as "HI" or "LO."

Figure 15:
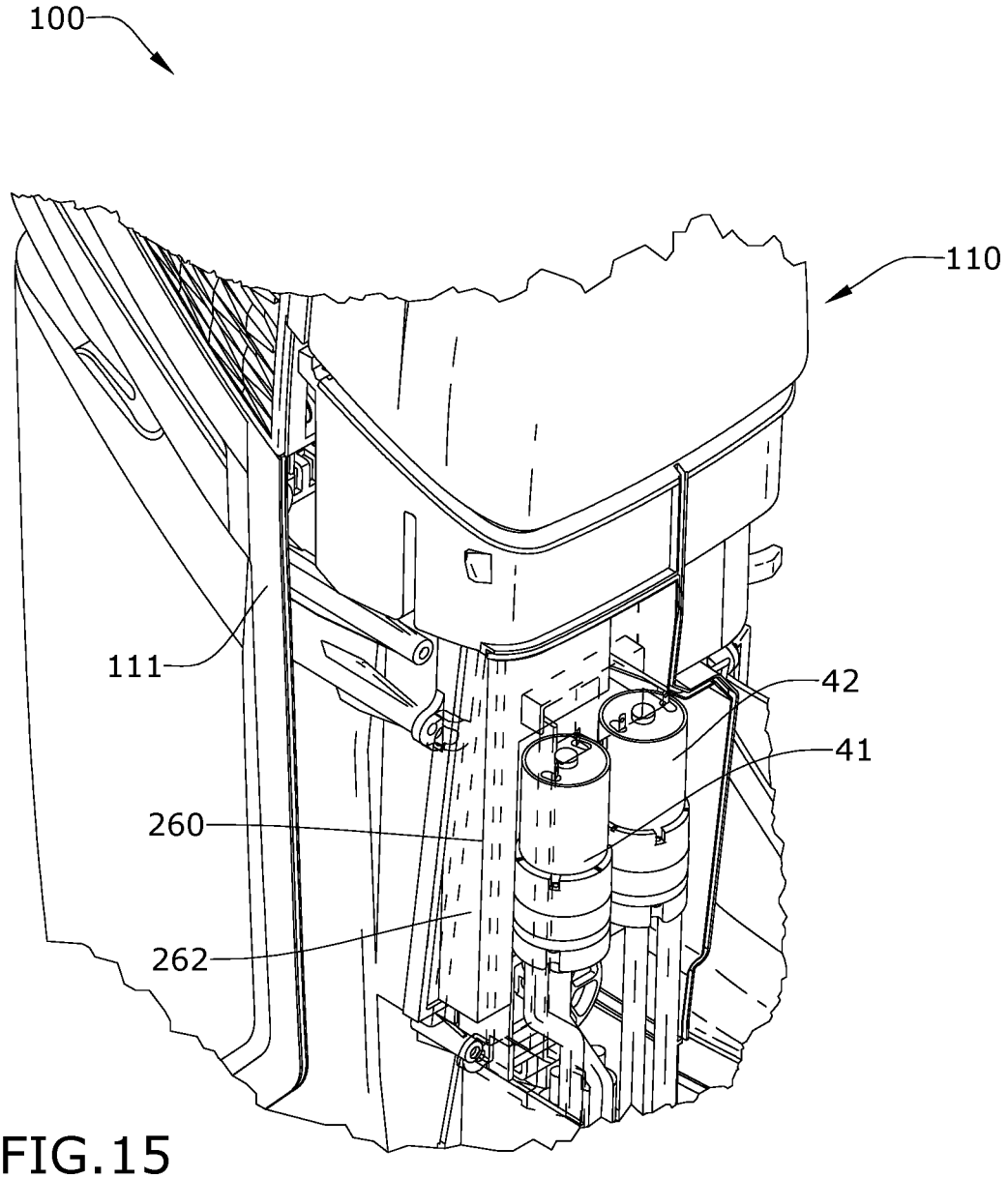
FIG. 15 is a perspective view of a portion of the upright extraction cleaner of FIG. 2 illustrating a circuit board according to various aspects described herein.

FIG. 15 further illustrates the rear of the upright extraction cleaner 100, where the circuit board 260 is more clearly visible alongside the first and second pumps 41, 42 in the upright assembly 110. It is further contemplated that the circuit board 260 can be removably mounted within the upright assembly 110, such as behind a removable cover 262 for convenient servicing or repair. For example, both the circuit board 260 and removable cover 262 can be mounted by fasteners such as screws or bolts, where removal of the cover 262 can expose portions of the circuit board 260 for servicing. It is further contemplated that all electrical connections to the circuit board 260 can be of a "quick connect" type such as a removable plug, as opposed to traditional hard-wiring of electrical connections to circuit boards. In the event that a more thorough servicing of the circuit board 260 is desired, all electrical connections can be unplugged and the circuit board 260 can be removed.

Figure 16:
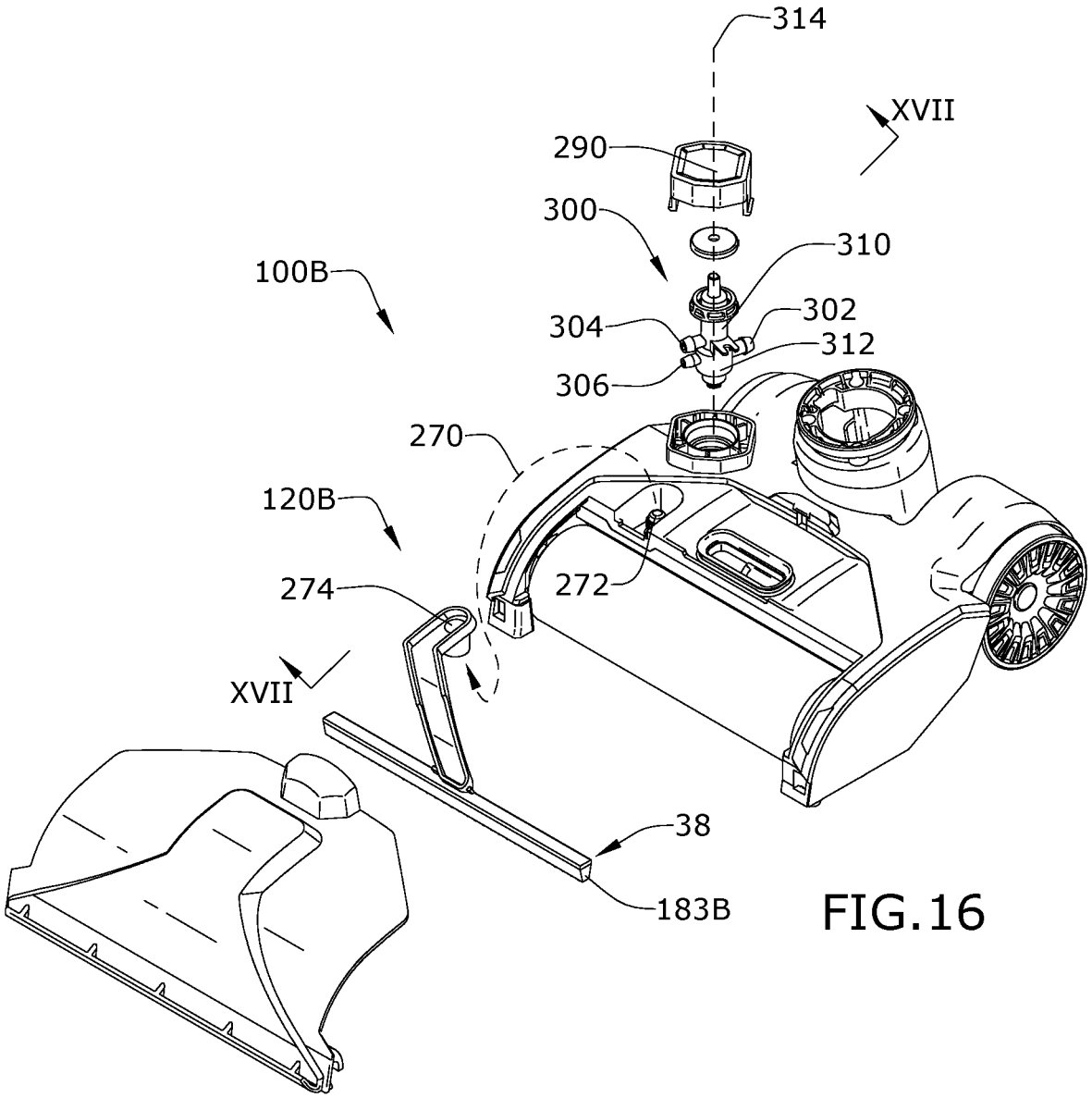
FIG. 16 is a partially-exploded view of a portion of the surface cleaning apparatus of FIG. 1 in the form of an alternate upright extraction cleaner including a base assembly with a push-push valve according to various aspects described herein.

FIG. 16 illustrates a base assembly 120B of another upright extraction cleaner 100B according to various aspects described herein. The upright extraction cleaner 100B is similar to the upright extraction cleaner 100; therefore, like parts will be identified with like numerals appended with the letter 'B,' where the description of the like parts of the upright extraction cleaner 100 applies to the upright extraction cleaner 100B, except where noted. It is also contemplated that the upright extraction cleaner 100B can include any or all of the various systems and components described in FIG. 1, including a fluid delivery system 12 for storing and delivering a cleaning fluid to the surface to be cleaned and a recovery system 14 for extracting and storing the dispensed cleaning fluid, dirt and debris from the surface to be cleaned. One difference is that the fluid delivery system 12 includes a single pump 40 (FIG. 1), such as a single solenoid pump. It is further contemplated that the base assembly 120B can also include multiple, interchangeable cleaning nozzles and agitators as described above.

The upright extraction cleaner 100B includes a base assembly 120B with the fluid distributor 38. The arrow 270 schematically illustrates a fluid connection from an outlet port 272 within the base assembly 120B to an inlet port 274 of the fluid distributor 38, such as a spray bar 183B. Optionally, the base assembly 120B can include a base distributor (not shown) similar to the base distributor 144 (FIG. 2).

One difference is that the base assembly 120B further includes a control pedal 290 configured to activate a push-push flow control mechanism, illustrated as a mechanically-activated push-push valve 300. The push-push valve 300 can include a valve inlet 302, a first valve outlet 304, and a second valve outlet 306. The push-push flow control valve 300 has a "push once/push twice" configuration, where pushing the control pedal 290 initiates a first fluid flow through the valve 300 and subsequently pushing the control pedal 290 again initiates a second fluid flow through the valve 300. In one example the first fluid flow can be "on" and the second fluid flow can be "off" e.g. zero fluid flow through the valve 300. In another example the first fluid flow can be a "high flow" state, and the second fluid flow can be a "low flow" state. In addition, a status indicator (not shown) can be provided on the control pedal 290, for example to indicate to the user which position the push-push valve 300 is currently in.

The push-push valve 300 is coupled with the pedal 290 and includes a valve body 310 that remains fixed in its location, as well as a valve piston 312 that moves up and down a central axis 314 of the valve 300. A plunger (not shown) can move up and down and rotate relative to the central axis 314 to provide differing states upon subsequent pushes on the valve 300. The pedal 290 acts as an interface between the user and the valve 300. It is contemplated that the pedal 290 and valve piston 312 can each be individually biased in an upward direction (e.g. via an attached spring, not shown).

In addition, the valve inlet 302 is in fluid communication with the single pump 40, and the first and second valve outlets 304, 306 are each in fluid communication with the distributor 38, such as the spray bar 183B. More specifically, the first and second valve outlet 304, 306 are each coupled to the spray bar 183B. When the push-push valve 300 is in an "upper" and "lower" position, cleaning fluid can be supplied by the pump 40 (FIG. 1) at a respective first and second volumetric flow rate.

Figure 17:
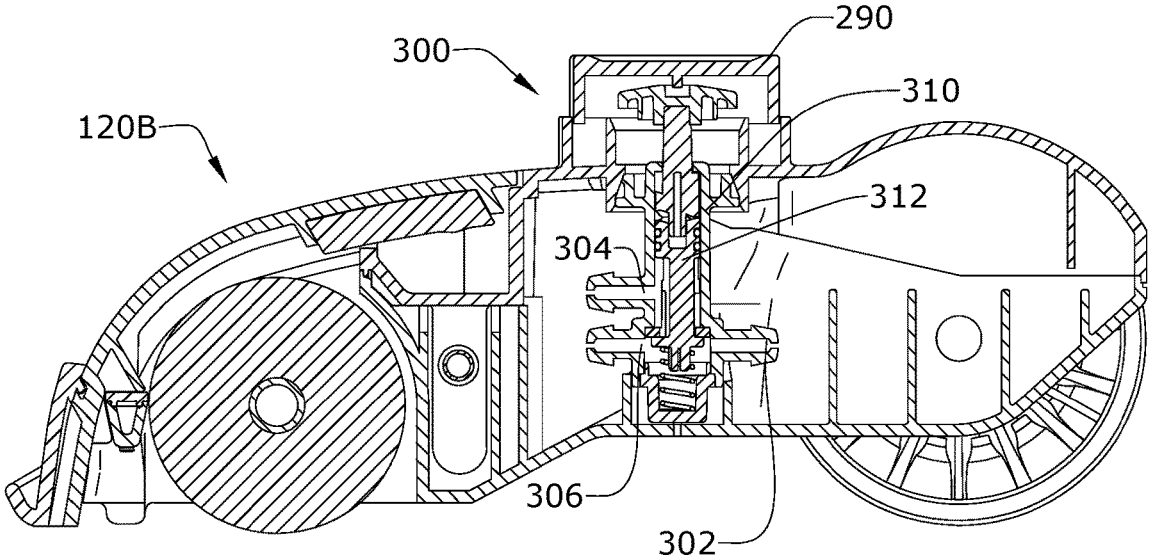
FIG. 17 is a sectional view of a base assembly of the surface cleaning apparatus of FIG. 16 taken along line XVII-XVII illustrating the push-push valve in a first position.

FIG. 17 illustrates a sectional view of the base assembly 120B with the push-push valve 300 in a "lower" configuration. A passageway or fluid pathway through the valve body 310 connects the valve inlet 302 and valve outlets 304, 306. Cleaning fluid is supplied from the pump 40 (FIG. 1) through the valve inlet 302 and into the valve body 310. In the "lower" position illustrated, the valve piston 312 is positioned within the valve body 310 so as not to block either of the first or second valve outlets 304, 306. Cleaning fluid can thus be supplied to the spray bar 183B via both of the outlets 304, 306, thus forming a "high" volumetric flow rate supplied by the pump 40.

Figure 18:
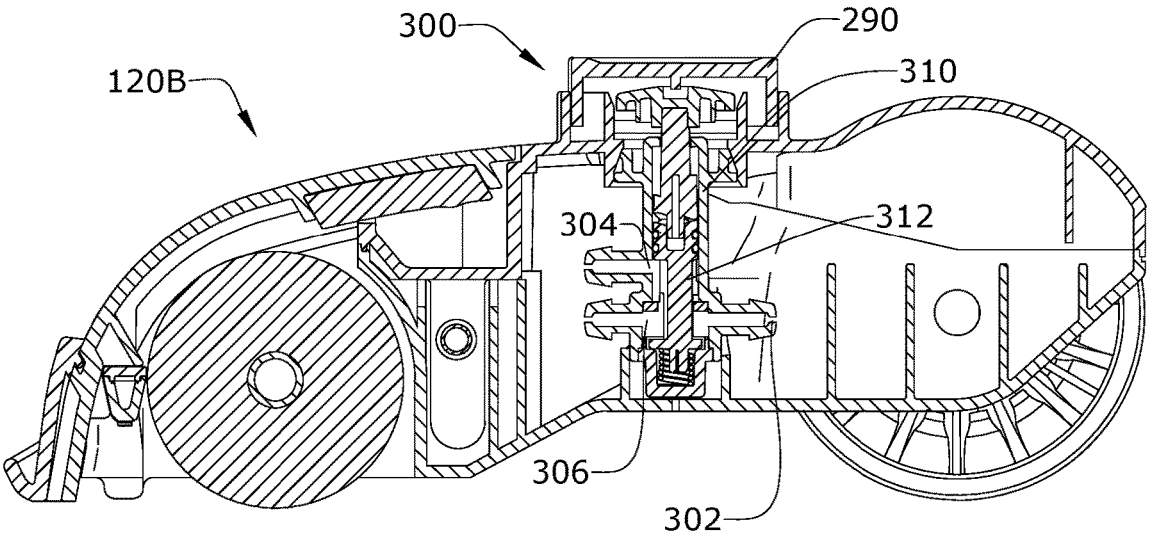
FIG. 18 is a sectional view similar to that of FIG. 17 illustrating the push-push valve in a second position.

FIG. 18 illustrates a sectional view of the base assembly 120B with the push-push valve 300 in an "upper" position. In the "upper" position, the valve piston 312 blocks the first valve outlet 304 while the second valve outlet 306 remains open. Cleaning fluid flowing through the valve inlet 302 can flow to the spray bar 183B via the second valve outlet 306 alone, thereby forming a "low" volumetric flow rate supplied by the pump 40 (FIG. 1). It can be appreciated that a single pump can provide a plurality of flow rates through use of the push-push valve 300.

While not illustrated, it is further contemplated that either or both of the valve outlets 304, 306 can also supply a base distributor (not shown). For example, the "lower" configuration (FIG. 17) of the push-push valve 300 can supply cleaning fluid to both the spray bar 183B and base distributor, while the "upper" configuration (FIG. 18) can supply cleaning fluid to the spray bar 183B alone. It will be appreciated that other combinations or arrangements of the push-push valve 300 and supplied flow rates to components of the distributor 38 are contemplated for use.

In another example the push-push control valve 300 can be replaced by a momentary flow control mechanism such as a spring biased momentary valve. In such a case, pushing the control pedal 290 could initiate a first fluid flow through the valve 300, and releasing the control pedal 290 could initiate a second fluid flow through the valve 300 (e.g. by closing the valve 300). This is unlike the push-push flow control mechanism, which continues a first fluid flow after the control pedal is initially depressed until the control pedal 290 is depressed a second time to initiate a second fluid flow.

Aspects of the present disclosure provide for a variety of benefits. The use of multiple pumps, the use of multiple flow rates for a given pump, and combinations thereof provide for the tailoring of fluid flow rates when delivering cleaning fluid to a surface. It can be appreciated that different surface types e.g. hard surfaces or carpet, as well as inconsistent degrees of soiling present on a given surface to be cleaned, can benefit from a variable flow rate of cleaning fluid delivered to the surface. Increasing a flow rate of cleaning fluid on a heavily soiled surface when desired, or decreasing a cleaning fluid flow rate for less soiled surfaces, can improve the efficiency of the cleaning process and reduce the operating time of the surface cleaning apparatus. In addition, the use of interchangeable nozzles and brushrolls provides for further customizing of a cleaning process on a variety of floor types. The microfiber and bristled brushrolls, in addition to the variable flow rates provided by the pumps or push-push valve, provide for optimal extraction and cleaning of hard and soft surfaces with variable levels of soiling. It can also be appreciated that keyed or locating features on the interchangeable nozzles or brushrolls can prevent accidental mis-assembly by a user.

In addition, it can be appreciated that the removable cover of the circuit board provides for improved access to electronic components of the surface cleaning apparatus, as well as providing for most cost-effective servicing processes. In traditional extraction cleaners with non-removable circuit boards, a customer may be asked to bring the entire extraction cleaner in for servicing. The improved circuit board as described herein can be removably coupled to the various electronic components within the extraction cleaner, thereby simplifying the servicing process. Further, the internally-coiled wiring of the telescoping handle provides for simplified storage of electronic wiring as well as a compactable form for the extraction cleaner.

Further, the improved two-piece float assembly provides for increased ease of cleaning. As the float portion remains within the recovery tank, dirt and debris can be prevented from getting caught on the float mechanism during use.

Aspects of the present disclosure may be used on other types of extraction cleaners, including, but not limited to, a canister device having a cleaning implement connected to a wheeled base by a vacuum hose, a portable extractor adapted to be hand carried by a user for cleaning relatively small areas, or a commercial extractor. For example, any of the examples can be combined with an extraction cleaner as generally outlined with respect to FIG. 1. Still further, aspects of the present disclosure may also be used on surface cleaning apparatus other than extraction cleaners, such as a vacuum cleaner or steam cleaner. A vacuum cleaner typically does not deliver or extract liquid, but rather is used for collecting relatively dry debris (which may include dirt, dust, stains, soil, hair, and other debris) from a surface. A steam cleaner generates steam for delivery to the surface to be cleaned, either directly or via cleaning pad. Some steam cleaners collect liquid in the pad, or may extract liquid using suction force.

The disclosed embodiments are representative of preferred forms and are intended to be illustrative rather than definitive of the disclosure. To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. Reasonable variation and modification are possible without departing from the scope of the disclosure.

Further aspects of the invention are provided by the subject matter of the following clauses:

1. A surface cleaning apparatus, having a housing including an upright assembly and a base pivotally mounted to the upright assembly and adapted for movement across a surface to be cleaned, a working air path through the housing, a recovery container provided on the housing and defining a portion of the working air path, a suction source provided on the housing and defining a portion of the working air path, and a suction nozzle assembly removably mounted on the base and at least partially defining a suction nozzle inlet adapted to be adjacent the surface to be cleaned and at least partially defining an agitator chamber, a fluid delivery system provided on the housing and including: a fluid supply container configured to store a supply of cleaning fluid, a fluid distributor in fluid communication with the fluid supply container and configured to dispense cleaning fluid to the surface to be cleaned, the fluid distributor carried on an upper exterior portion of the suction nozzle assembly and configured to spray forwardly of the base housing, a flow control actuator configured to control a flow of cleaning fluid from the fluid supply container to the fluid distributor; and an agitator removably mounted within the agitator chamber.

2. The surface cleaning apparatus of any preceding clause, further comprising at least one of a wiper or a squeegee mounted to the base or the suction nozzle assembly.

3. The surface cleaning apparatus of any preceding clause, further comprising a catch located on one of the base or the suction nozzle assembly and a latch provided on the other of the base or the suction nozzle assembly.

4. The surface cleaning apparatus of any preceding clause wherein when the suction nozzle assembly is mounted to the base, at least a portion of the fluid distributor is located above the agitator.

5. The surface cleaning apparatus of any preceding clause, further comprising a battery operated power source operably coupled to the suction source and wherein the surface cleaning apparatus is cordless.

6. The surface cleaning apparatus of any preceding clause wherein the agitator is a microfiber brushroll.

7. A surface cleaning apparatus, including a housing, a working air path through the housing, a recovery container provided on the housing and defining a portion of the working air path, a suction source provided on the housing and defining a portion of the working air path, and a fluid delivery system provided on the housing and including a fluid supply container configured to store a supply of cleaning fluid, a fluid distributor in fluid communication with the fluid supply container and configured to dispense cleaning fluid to the surface to be cleaned, a flow control actuator configured to control a flow of cleaning fluid from the fluid supply container to the fluid distributor, a set of removeable nozzles selectively operably coupled to the housing and wherein when one of the set of removeable nozzles is operably coupled to the housing, the one of the set of removeable nozzles carries the fluid distributor thereon, at least partially defines a suction nozzle inlet adapted to be adjacent the surface to be cleaned and fluidly coupled to the working air path, and at least partially defining an agitator chamber, and a set of agitators selectively receivable within the agitator chamber.

8. The surface cleaning apparatus of any preceding clause wherein one of the set of removeable nozzles comprises a hard surface cleaning nozzle and one of the set of agitators comprises a microfiber brushroll.

9. The surface cleaning apparatus of any preceding clause wherein the microfiber brushroll comprises a first keyed feature compatible with the hard surface cleaning nozzle for receipt therein.

10. The surface cleaning apparatus of any preceding clause wherein the set of agitators further comprises at least one of a bristled brushroll having a second keyed feature incompatible with the hard surface cleaning nozzle or a hybrid brushroll having a second keyed feature incompatible with the hard surface cleaning nozzle.

11. The surface cleaning apparatus of any preceding clause wherein the hard surface cleaning nozzle includes a modular unit defining a first suction inlet and a second suction inlet.

12. The surface cleaning apparatus of any preceding clause, further comprising a squeegee mounted proximate to the second suction inlet.

13. The surface clearing apparatus of any preceding clause wherein the fluid distributor is carried on an upper exterior portion of the hard surface cleaning nozzle.

14. The surface cleaning apparatus of any preceding clause wherein another of the set of removeable nozzles comprises a carpet cleaning nozzle and another of the set of agitators comprises a bristle brushroll.

15. The surface cleaning apparatus of any preceding clause wherein the bristle brushroll includes a second keyed feature compatible with the carpet cleaning nozzle for receipt therein and incompatible with the hard surface cleaning nozzle.

16. The surface cleaning apparatus of any preceding clause, further comprising at least one of a wiper or a squeegee mounted to the housing or the one of the set of removeable nozzles.

17. The surface cleaning apparatus of any preceding clause wherein the housing includes a base housing and the one of the set of removeable nozzles is mounted to a forward portion of the base housing.

18. The surface cleaning apparatus of any preceding clause, further comprising a catch located on one of the base housing or the one of the set of removeable nozzles and a latch provided on the other of the base housing or the one of the set of removeable nozzles.

19. The surface cleaning apparatus of any preceding clause wherein when the one of the set of removeable nozzles is mounted to the housing, at least a portion of the fluid distributor is located above the agitator chamber.

20. The surface cleaning apparatus of any preceding clause, further comprising a battery operated power source operably coupled to the suction source and wherein the surface cleaning apparatus is cordless.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A surface cleaning apparatus, comprising:

an upright assembly including a frame and a handle at least partially extending from the frame, the handle moveable between an extended position and a contracted position;

a power source operably coupled to at least a portion of the upright assembly; and a coiled electrical cable provided within a portion of the handle and operably coupled to the power source, the coiled electrical cable configured to uncoil or coil when the handle is moved between the extended position and the contracted position.

2. The surface cleaning apparatus of claim 1, wherein the handle is a telescoping handle.

3. The surface cleaning apparatus of claim 2, further comprising at least one electronic control provided along a portion of the telescoping handle and wherein the at least one electronic control is operably coupled to the power source through the coiled electric cable.

4. The surface cleaning apparatus of claim 3, further comprising a fluid delivery system and a suction source that are each operably coupled to the power source.

5. The surface cleaning apparatus of claim 4, wherein the at least one electronic control is configured to selectively operate at least one of the power source, at least a portion of the fluid delivery system, or the suction source.

6. The surface cleaning apparatus of claim 4, wherein the at least one electronic control includes a first electronic control, a second electronic control, and a third electronic control that are each operably coupled to the power source through the coiled electric cable.

7. The surface cleaning apparatus of claim 6, wherein the first electronic control is configured to selectively operate the power source, the second electronic control is configured to selectively operate at least a portion of the fluid delivery system, and the third electronic control is configured to selectively operate the suction source.

8. The surface cleaning apparatus of claim 3, further comprising a base assembly having an agitator, wherein the at least one electronic control is configured to selectively operate the agitator.

9. The surface cleaning apparatus of claim 3, further comprising wiring provided within a portion of the telescoping handle and operably coupling the at least one electronic control to the coiled electrical cable.

10. The surface cleaning apparatus of claim 9, wherein the wiring is a non-coiled wiring.

11. The surface cleaning apparatus of claim 9, wherein the telescoping handle further comprises:

a telescoping tube defining an interior and at least partially provided within the frame when the telescoping handle is in the contracted position; and a hand grip exterior of the frame;

wherein the coiled electrical cable is provided within the interior.

12. The surface cleaning apparatus of claim 11, wherein the wiring extends between the telescoping tube and the hand grip.

13. The surface cleaning apparatus of claim 1, further comprising a circuit board provided along the upright assembly and electronically coupled to the coiled electrical cable and the power source.

14. The surface cleaning apparatus of claim 13, wherein the circuit board is removably mounted within the upright assembly.

15. The surface cleaning apparatus of claim 14, wherein the circuit board is removably mounted within the upright assembly behind a removable cover.

16. The surface cleaning apparatus of claim 13, wherein the coiled electrical cable and the power source are removably electrically coupled to the circuit board.

17. The surface cleaning apparatus of claim 1, wherein the power source is a battery.

18. The surface cleaning apparatus of claim 17, wherein the surface cleaning apparatus is cordless.

19. The surface cleaning apparatus of claim 1, further comprising:

a housing including the upright assembly and a base assembly pivotally mounted to the upright assembly and adapted for movement across a surface to be cleaned;

a working air path through the housing;

a recovery container provided on the housing and defining a portion of the working air path;

a suction source provided on the housing and defining a portion of the working air path;

a suction nozzle assembly removably mounted on the base assembly and at least partially defining a suction nozzle inlet adapted to be adjacent the surface to be cleaned and at least partially defining an agitator chamber;

a fluid delivery system provided on the housing; and an agitator removably mounted within the agitator chamber.

20. The surface cleaning apparatus of claim 19, further comprising at least one electronic control provided along a portion of the handle and configured to selectively operate at least one of the power source, the suction source, at least a portion of the fluid delivery system, or the agitator.

* * * * *